US006935542B2

(12) United States Patent
Harrity et al.

(10) Patent No.: US 6,935,542 B2
(45) Date of Patent: Aug. 30, 2005

(54) DEVICE FOR RETAINING AND FOR INSERTING A FLEXIBLE TUBE ASSEMBLY INTO A FLUID CONTAINER

(75) Inventors: Kevin Harrity, Oak Creek, WI (US); Timothy R. Bartlett, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 399 days.

(21) Appl. No.: 10/144,866

(22) Filed: May 15, 2002

(65) Prior Publication Data

US 2003/0213816 A1 Nov. 20, 2003

(51) Int. Cl.[7] ..... B67D 5/40
(52) U.S. Cl. ..... 222/382; 222/464.4
(58) Field of Search ..... 222/382, 464.4, 222/383.1, 464.3, 529

(56) References Cited

U.S. PATENT DOCUMENTS

| | | | | |
|---|---|---|---|---|
| 1,783,419 | A | 12/1930 | Fitch | 222/309 |
| 1,887,013 | A | 11/1932 | Coffield | 169/72 |
| 1,959,102 | A | 5/1934 | Hummel | 299/95 |
| 2,128,494 | A | 8/1938 | Morrow | 221/51 |
| 2,311,845 | A | 2/1943 | Lindsay | 169/31 |
| 2,372,678 | A | 4/1945 | McKay | 299/89 |
| 2,483,661 | A | 10/1949 | Neas | 62/1 |
| 2,494,837 | A | 1/1950 | Simmons | 299/97 |
| 2,518,709 | A | 8/1950 | Mosby, Jr. | 299/84 |
| 2,530,583 | A | 11/1950 | Nurkiewicz | 169/31 |
| 2,647,796 | A | 8/1953 | Ziherl | 299/73 |
| 2,796,294 | A | 6/1957 | McKinnon | 299/88 |
| 2,811,390 | A | 10/1957 | Kiraly | 299/95 |
| 2,920,798 | A | 1/1960 | Samuel | 222/394 |
| 3,088,680 | A | 5/1963 | Fulton et al. | 239/337 |
| 3,113,698 | A | 12/1963 | Abplanalp | 222/1 |
| 3,211,349 | A | 10/1965 | Prussin et al. | 222/394 |
| 3,260,421 | A | 7/1966 | Rabussier | 222/394 |
| 3,278,086 | A | 10/1966 | Clouzeau et al. | 222/135 |
| 3,282,510 | A | 11/1966 | Van Schwartz | 239/373 |
| 3,292,827 | A | 12/1966 | Frangos | 222/402.24 |
| 3,301,438 | A | 1/1967 | Tillotson | 222/41 |
| 3,401,844 | A | 9/1968 | Hanson, Jr. | 222/635 |
| 3,411,648 | A | 11/1968 | Tichy | 215/11 |
| 3,490,656 | A | 1/1970 | Taschner | 222/394 |
| 3,547,296 | A | 12/1970 | Greenberg | 215/11 |

(Continued)

FOREIGN PATENT DOCUMENTS

| | | |
|---|---|---|
| EP | 0 285 040 A2 | 10/1988 |
| EP | 0 687 639 B1 | 4/1997 |
| EP | 1151802 A2 | 11/2001 |
| FR | 2700483 A1 | 7/1994 |
| GB | 735659 | 8/1955 |
| GB | 2 136 057 A | 9/1984 |
| JP | 9-75800 | 3/1997 |
| JP | 9-103717 | 4/1997 |
| JP | 9-122546 | 5/1997 |
| JP | 9-276757 | 10/1997 |
| JP | 11-180481 | 7/1999 |
| WO | WO 94/27733 | 12/1994 |
| WO | WO 96/01784 | 1/1996 |
| WO | WO 96/12670 | 5/1996 |
| WO | WO 01/27020 A1 | 4/2001 |

*Primary Examiner*—Philippe Derakshani

(57) ABSTRACT

A device for use with a container having a container top includes a tubular retainer engaging the container top and a tube assembly. The tubular retainer has a retainer top, a retainer bottom, a longitudinal axis, and an inner passageway formed along the longitudinal axis and defined by an inner surface. The tube assembly is frictionally disposed within the inner passageway of the tubular retainer. The tube assembly comprises (i) a tube having a first end and a second end, (ii) a weight attached to the second end of the tube, and (iii) an adapter attached to the first end of the tube.

53 Claims, 21 Drawing Sheets

U.S. PATENT DOCUMENTS 3,580,430 A 5/1971 Angele ..... 222/394
3,631,880 A 1/1972 Hansel ..... 137/172
3,667,655 A 6/1972 Knieriem, Jr. ..... 222/464
3,672,028 A 6/1972 Bollng ..... 29/208 B
3,674,179 A 7/1972 Galloway ..... 222/94
3,880,207 A 4/1975 Giuffredi ..... 141/20
4,069,950 A 1/1978 Archer ..... 222/210
4,077,442 A 3/1978 Olofsson ..... 141/20
4,083,476 A 4/1978 Schwartz et al. ..... 222/321
4,154,378 A 5/1979 Paoletti et al. ..... 222/394
4,174,790 A 11/1979 Nozawa et al. ..... 222/321
4,273,272 A 6/1981 Blanc ..... 222/464
4,418,846 A 12/1983 Pong et al. ..... 222/189
4,546,905 A 10/1985 Nandagiri et al. ..... 222/189
4,610,345 A 9/1986 Spreen et al. ..... 198/392
4,730,751 A 3/1988 Mackles et al. ..... 222/189
4,775,079 A 10/1988 Grothoff ..... 222/321
4,779,714 A 10/1988 Madden ..... 198/399
4,830,235 A 5/1989 Miller ..... 222/464
4,958,754 A 9/1990 Dennis ..... 222/383
5,119,974 A 6/1992 Mann ..... 222/376
5,192,007 A 3/1993 Blomquist ..... 222/376
5,195,664 A 3/1993 Rhea ..... 222/464
5,219,098 A 6/1993 Tada ..... 222/153
5,222,632 A 6/1993 Tada ..... 222/153
5,222,636 A 6/1993 Meuresch ..... 222/321
5,341,967 A 8/1994 Silvenis ..... 222/376
5,353,969 A 10/1994 Balderrama ..... 222/321
5,373,973 A 12/1994 Foster ..... 222/324
5,381,961 A 1/1995 Evans et al. ..... 239/333
5,397,034 A 3/1995 Wunsch ..... 222/333
5,462,209 A 10/1995 Foster et al. ..... 222/376
5,467,901 A 11/1995 Foster et al. ..... 222/376
5,540,360 A 7/1996 Foster et al. ..... 222/376
5,553,750 A 9/1996 Foster ..... 222/179.5
5,636,770 A 6/1997 Hachinohe et al. ..... 222/402.1
5,655,714 A 8/1997 Kieffer et al. ..... 239/318
5,657,909 A 8/1997 Barriac ..... 222/382
5,738,252 A 4/1998 Dodd et al. ..... 222/376
5,775,548 A 7/1998 Hohmann et al. ..... 222/376
5,803,319 A 9/1998 Smith et al. ..... 222/402.19
5,839,620 A 11/1998 Battegazzore ..... 222/382
5,871,122 A 2/1999 Klima et al. ..... 222/130
5,890,624 A 4/1999 Klima et al. ..... 222/82
5,899,366 A 5/1999 Ellion ..... 222/376
5,934,519 A 8/1999 Kim et al. ..... 222/464.4
5,944,223 A 8/1999 Klima et al. ..... 222/129
5,979,712 A 11/1999 Montaner et al. ..... 222/321.4
5,979,715 A 11/1999 Emrick ..... 222/464.4
5,988,454 A 11/1999 Ellion ..... 222/376
6,027,041 A 2/2000 Evans ..... 239/334
6,050,459 A 4/2000 Johnson et al.
6,102,078 A 8/2000 Kramer, Jr. ..... 138/122
6,102,255 A 8/2000 Ellion ..... 222/321.4
6,126,042 A 10/2000 Meshberg ..... 222/321.4
6,179,170 B1 1/2001 Bachand ..... 222/402.19
6,196,413 B1 3/2001 Tung ..... 220/709
6,202,943 B1 3/2001 Evans et al. ..... 239/333
6,264,073 B1 7/2001 Good et al. ..... 222/464.4
6,269,976 B1 8/2001 DeJonge
6,293,441 B1 9/2001 Tasaki et al. ..... 222/376
2001/0022324 A1 9/2001 Evans et al. ..... 239/333

DEVICE FOR RETAINING AND FOR INSERTING A FLEXIBLE TUBE ASSEMBLY INTO A FLUID CONTAINER

FIELD OF THE INVENTION

This invention relates generally to a device for retaining and for inserting a flexible tube assembly into a fluid container.

BACKGROUND OF THE INVENTION

Many consumers use products in the form of a fluid that can be dispensed from containers by being sprayed on a variety of surfaces, such as windows, wood finishes, bathroom tiles, bathtubs, sinks, and many others. Typically, the fluid contains chemical agents used to clean, polish, disinfect, etc., such surfaces. These products often are sold as a package that includes a container, which holds the fluid, and a hand-actuated spraying device. The hand-actuated spraying device is connected to a dip tube, which is typically a straight, plastic, hollow tube (i.e., a dip tube) extending from the spraying device approximately to the bottom of the container. The hand-actuated spraying device includes a pump actuated by, for example, a trigger, so that when the trigger is pulled, the fluid is withdrawn from the bottom of the container through the tube and the hand-actuated spraying device, to be dispensed onto the surface to be cleaned.

When cleaning various places within the house with such products, a consumer often tilts the container at a severe angle to reach difficult-to-reach places, such as a shower head in a shower or around a toilet bowl. A problem with apparatuses of this type is that as the volume of fluid is dispensed and the level reaches the bottom of the container, it becomes difficult for the spraying device to withdraw the fluid from the container, especially if the container is tilted at a severe angle. The reason for this difficulty stems from the fact that the fluid is forced by gravity into the lowest bottom region of the container, which may result in, if the fluid level is low enough, the dip tube coming completely out of the fluid. If the consumer continues to actuate the trigger in this condition, the fluid remaining in the dip tube will be pumped out and the hand-actuated spraying device will begin pumping air. Often, the result is a messy foam dispensed from the spraying device. This is undesirable.

Also, there is an issue of cost, which is related to the ease of manufacturing the device. A product that always pumps fluid, but costs substantially more than products that function less well (but cost less) will not compete in the marketplace.

Accordingly, there is a need in the art for a device that enables a consumer to withdraw fluid from a dispensing container, even when the fluid level is low and the container is tilted at an angle. Also, the device should be cost effective.

SUMMARY OF THE INVENTION

The foregoing problems in the art are addressed by a first aspect of the invention, in which a device, for use with a container having a container top, includes a tubular retainer for engaging the container top and a tube assembly. The tubular retainer has a retainer top, a retainer bottom, a longitudinal axis, and an inner passageway formed along the longitudinal axis and defined by an inner surface. The tube assembly is frictionally disposed within the inner passageway of the tubular retainer. The tube assembly comprises (i) a tube having a first end and a second end, (ii) a weight attached to the second end of the tube, and (iii) an adapter attached to the first end of the tube.

In another aspect, the container has an opening in the container top. The retainer bottom engages the container top such that the adapter is vertically movable along the inner passageway of the tubular retainer to the opening in the container top.

In yet another aspect, the container has an interior chamber and a plurality of distances from a center of the opening to points of the interior chamber, and the tube has a length substantially equal to at least the longest of the plurality of distances from the center of the opening to the points of the interior chamber. The tubular retainer has a length that is substantially equal to at least the length of the tube such that substantially all of the tube assembly can be housed within the tubular retainer.

In still another aspect of the invention, the adapter includes (i) a plurality of spokes, (ii) an outer wall shaped to frictionally engage the inner surface of the tubular retainer, and (iii) a tube receiver having a longitudinal bore formed therein. The tube receiver frictionally engages the first end of the tube.

In another aspect of the invention, a tubular retainer comprises at least two flaps hinged to and integrally formed with the tubular retainer such that the flaps are movable between a holding position close to the longitudinal axis of the tubular retainer and a releasing position away from the longitudinal axis of the tubular retainer. The tube in this aspect is coiled within the tubular retainer, and the tube and the weight are supported by the flaps when the flaps are in the holding position.

In still another aspect of the invention, the tubular retainer is frictionally disposed in the interior chamber of the container.

Another aspect of the invention relates to a method of engaging a tube assembly with a container having a container top. The method includes the steps of assembling a tube assembly, inserting the tube assembly into a tubular retainer, and engaging the tubular retainer with the container top. The tube assembly includes an adapter, a tube connected to the adapter, and a weight connected to the tube. The tubular retainer has a retainer bottom and an inner passageway defined by an inner surface, such that by inserting the tube assembly the adapter frictionally engages the inner surface of the tubular retainer.

In another aspect of the invention, the tubular retainer includes a flared retainer bottom shaped to fit over an opening in the container top, and the engaging step comprises placing the flared retainer bottom over the opening of the container.

In still another aspect of the invention, the container has an opening in the container top and an interior chamber defined by a container inner surface. The engaging step comprises inserting the tubular retainer into the opening and frictionally engaging the tubular retainer with the container inner surface.

DETAILED DESCRIPTION OF THE PREFERRED EMBODIMENTS

Figure 1:
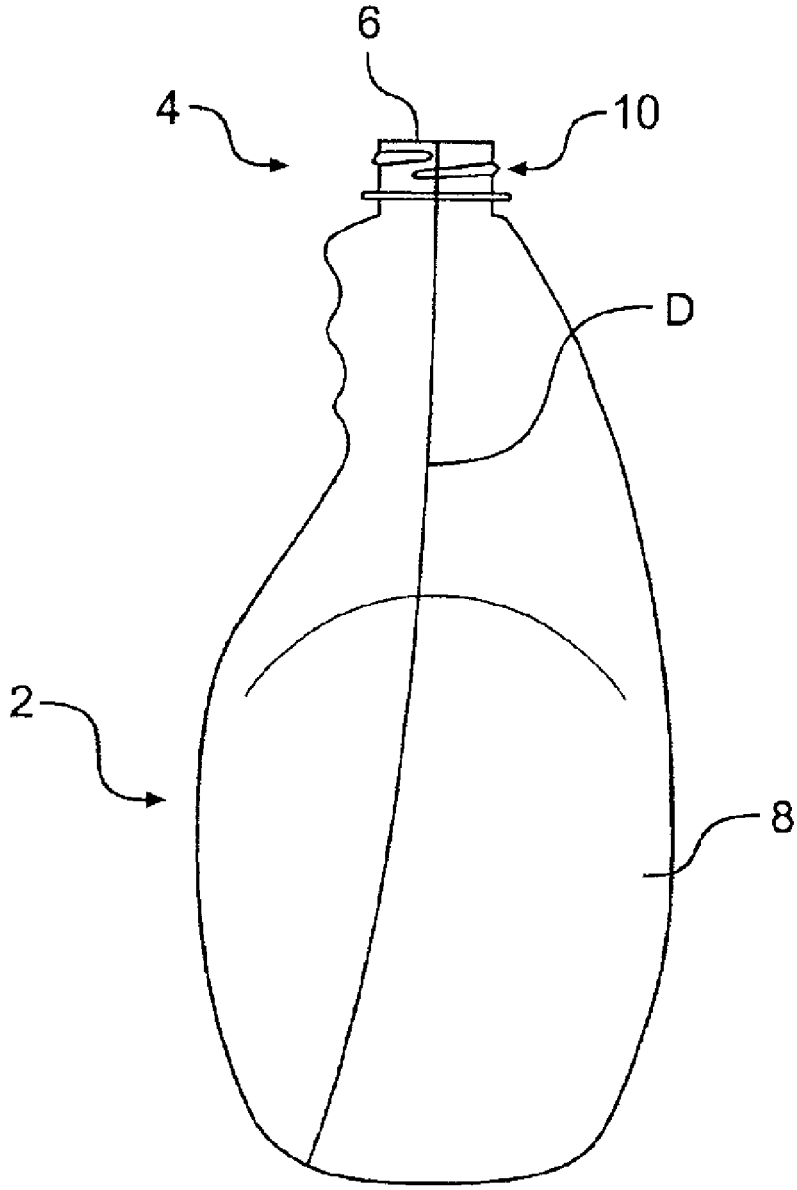
FIG. 1 is a side elevational view of a conventional container for use with the present invention.

The present invention is generally adapted for use with a container 2, as shown in FIG. 1. The container 2 is shown as having the form of a bottle, although it will be appreciated by those having ordinary skill that the container can have other shapes, such as a tub or a vase. The container 2 has a top 4, an opening 6 in the top 4 and an interior chamber 8. The opening 6 typically has a circular shape, but the opening 6 may be, for example, ovate, elliptical or rectilinear. The interior chamber 8 of the container 2 is adapted to hold a fluid, typically a household cleaner. On the exterior of the container 2, at the top 4, threads 10 are preferably provided, although the threads 10 are not required.

The container 2 defines a plurality of distances from the center of the opening 6 to any point on the bottom surface. As shown in FIG. 1, a longest distance D extends from the center of the opening 6 to an outside "corner" (i.e., the outermost point of the interior) of the bottom surface.

Figure 2:
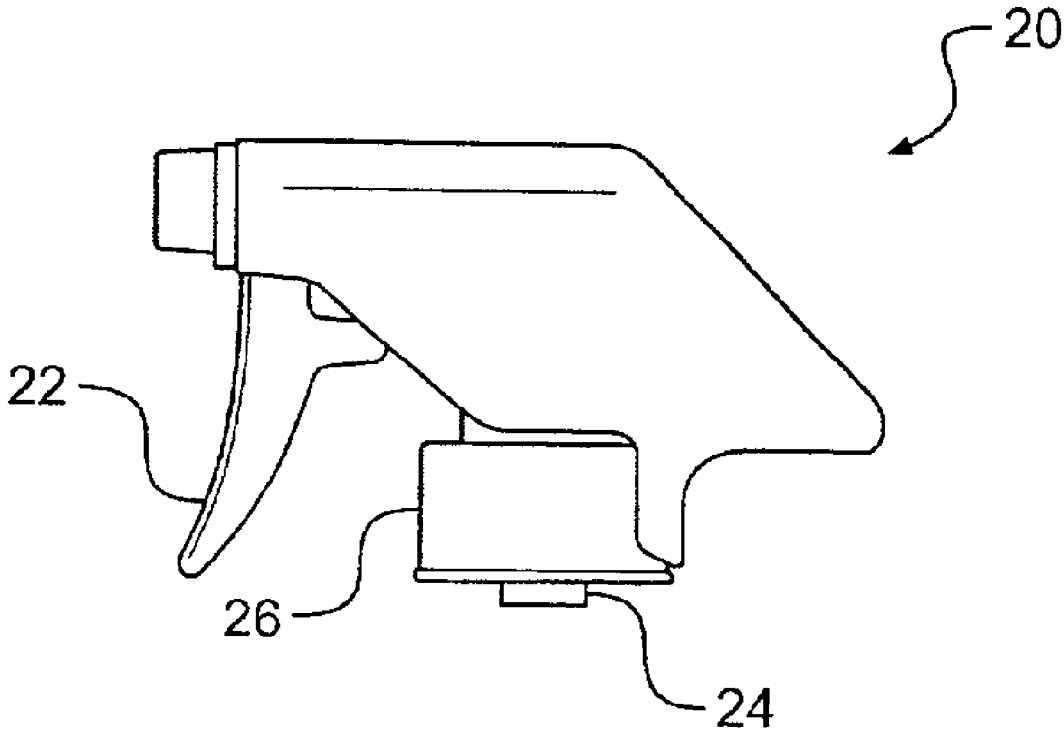
FIG. 2 is a side elevational view of a conventional trigger assembly for use with the present invention.

Referring to FIG. 2, the container 2 (not shown) is preferably used with a trigger assembly 20, which generally includes a trigger 22 that actuates a pump to pull fluid through an input spout 24, withdrawing fluid from the container 2. The trigger assembly 20 preferably comprises a lock ring 26 having threads on its inner surface that engage the threads 10 on the container 2 to secure the trigger assembly 20 to the container 2. The trigger assembly 20 is well known to consumers, and may be any suitable assembly known by those having ordinary skill in the art.

Although the trigger assembly 20 is preferably attached to the container 2 by way of the threads 10, other means for attaching the trigger assembly 20 to the container 2 are contemplated. For example, the trigger assembly 20 may be snapped onto the container 2, or permanently attached such as by ultrasonic, heat or vibration welding.

DETAILED DESCRIPTION OF THE FIRST EMBODIMENT

Figure 3:
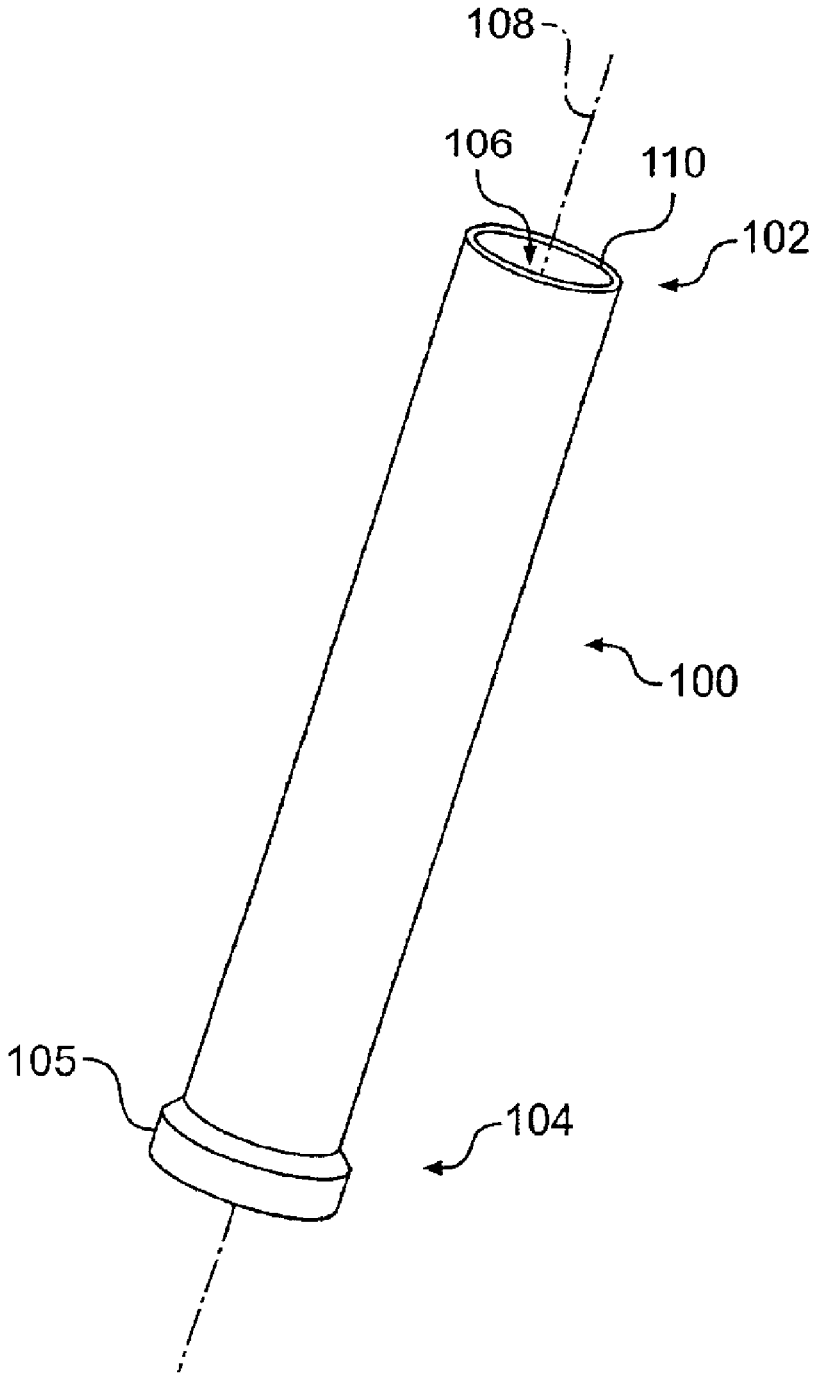
FIG. 3 is a perspective view of a tubular retainer according to the present invention.
Figure 4:
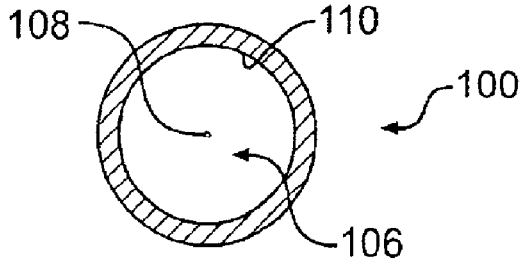
FIG. 4 is a cross-sectional view of the tubular retainer of FIG. 3 taken along a line perpendicular to the longitudinal axis of the tubular retainer.

As shown in FIG. 3, a retainer 100, which is tubular, comprises a top 102, a bottom 104, an inner passageway 106 running the length of the retainer 100 from the top 102 to the bottom 104, and a longitudinal axis 108. The inner passageway 106 is defined by an inner surface 110 (i.e., the inner surface 110 is a boundary of the passageway 106). As shown in FIG. 4, the shape of the inner passageway 106, when viewing a cross section of the retainer 100 in a plane perpendicular to the longitudinal axis 108, is preferably substantially the same as the shape of the opening 6 in the container 2. The shape of the inner passageway 106 shown in FIG. 4 is circular, since the tubular retainer 100 shown in FIGS. 3 and 4 is adapted for use with the container 2 shown in FIG. 1, which has a circular opening 6. In this embodiment, the inner diameter of the inner passageway 106 is preferably slightly larger than the diameter of the opening 6 in the container 2.

The length of the retainer 100 is preferably as long as the longest distance D from the center of the opening 6 in the container 2 to the furthest corner of the bottom surface. The length may of course be slightly longer or slightly shorter as desired.

Figure 5:
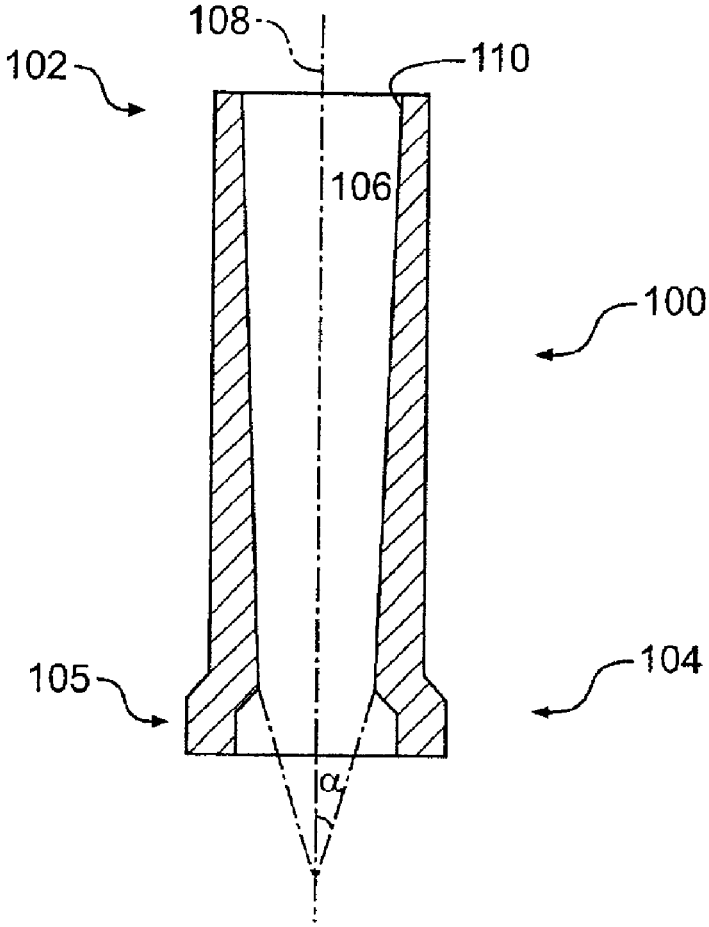
FIG. 5 is a cross-sectional view of the tubular retainer of FIG. 3 taken along the longitudinal axis of the tubular retainer.

As shown in FIG. 5, the inner surface 110 of the retainer 100 is preferably tapered so that as one looks down the longitudinal axis 108 from the top 102 to the bottom 104, points on the inner surface 110 get closer and closer to the longitudinal axis 108. The degree of taper a may vary, but is preferably a maximum of 1/8°. The taper has been exaggerated in FIG. 5 for illustration.

Figure 6A:
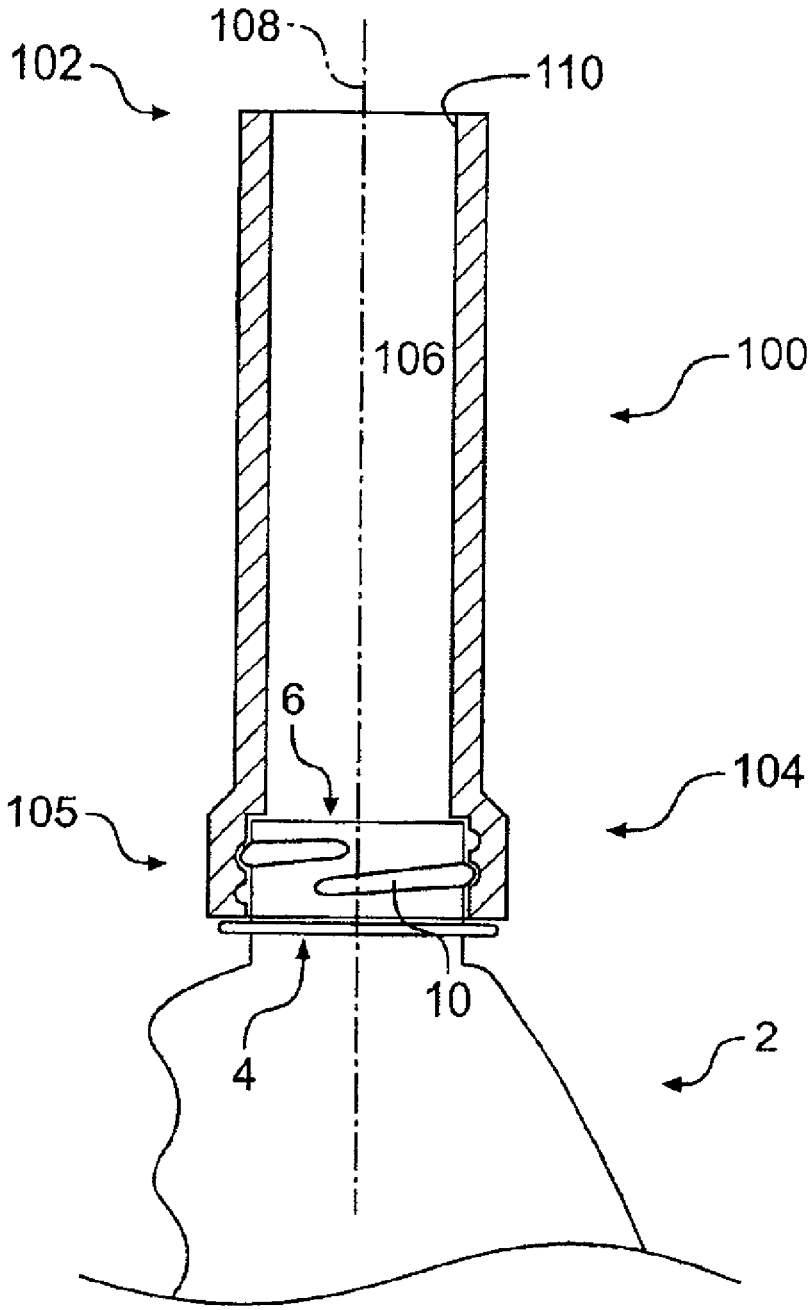
FIGS. 6A–6C are cross-sectional views of the bottom of the tubular retainer engaging the retainer.
Figure 6B:
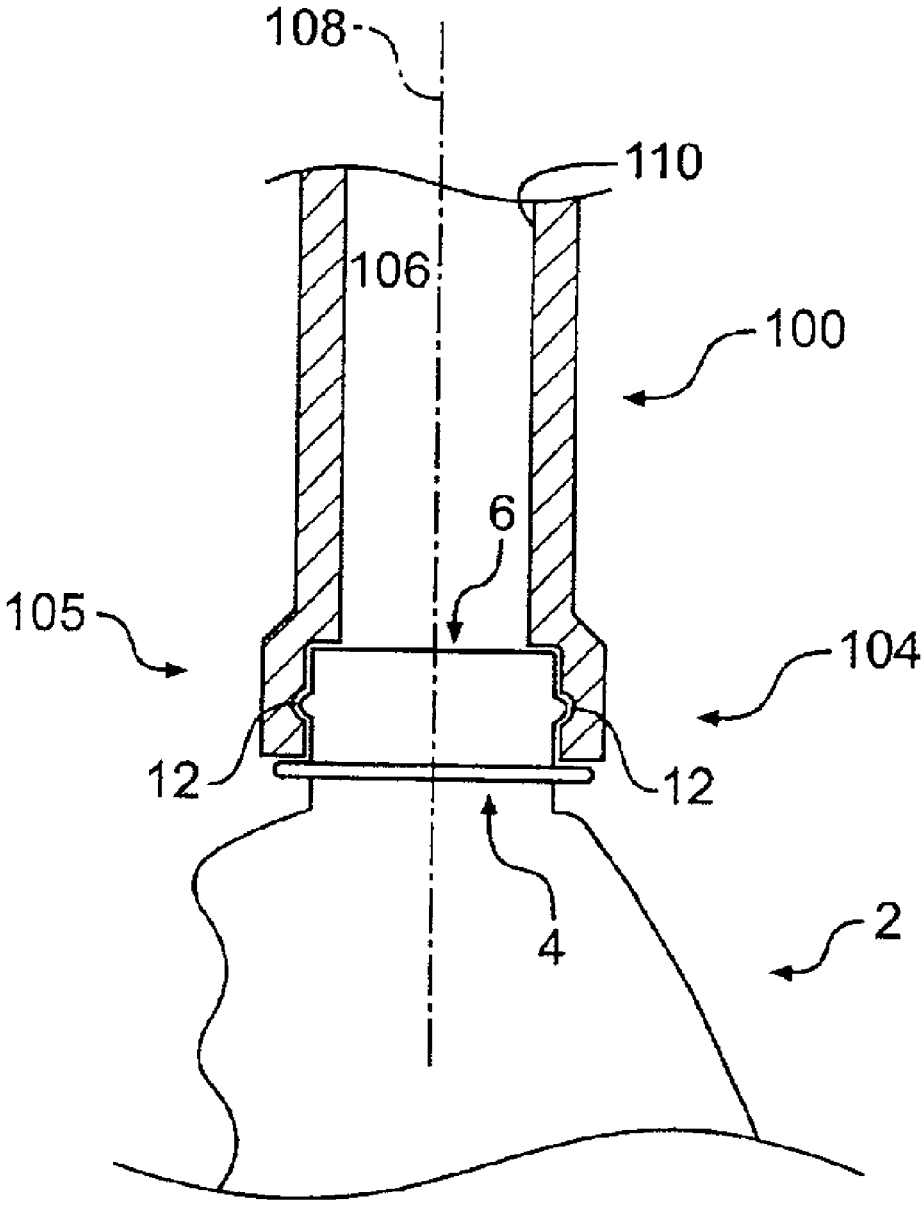
Figure 6C:
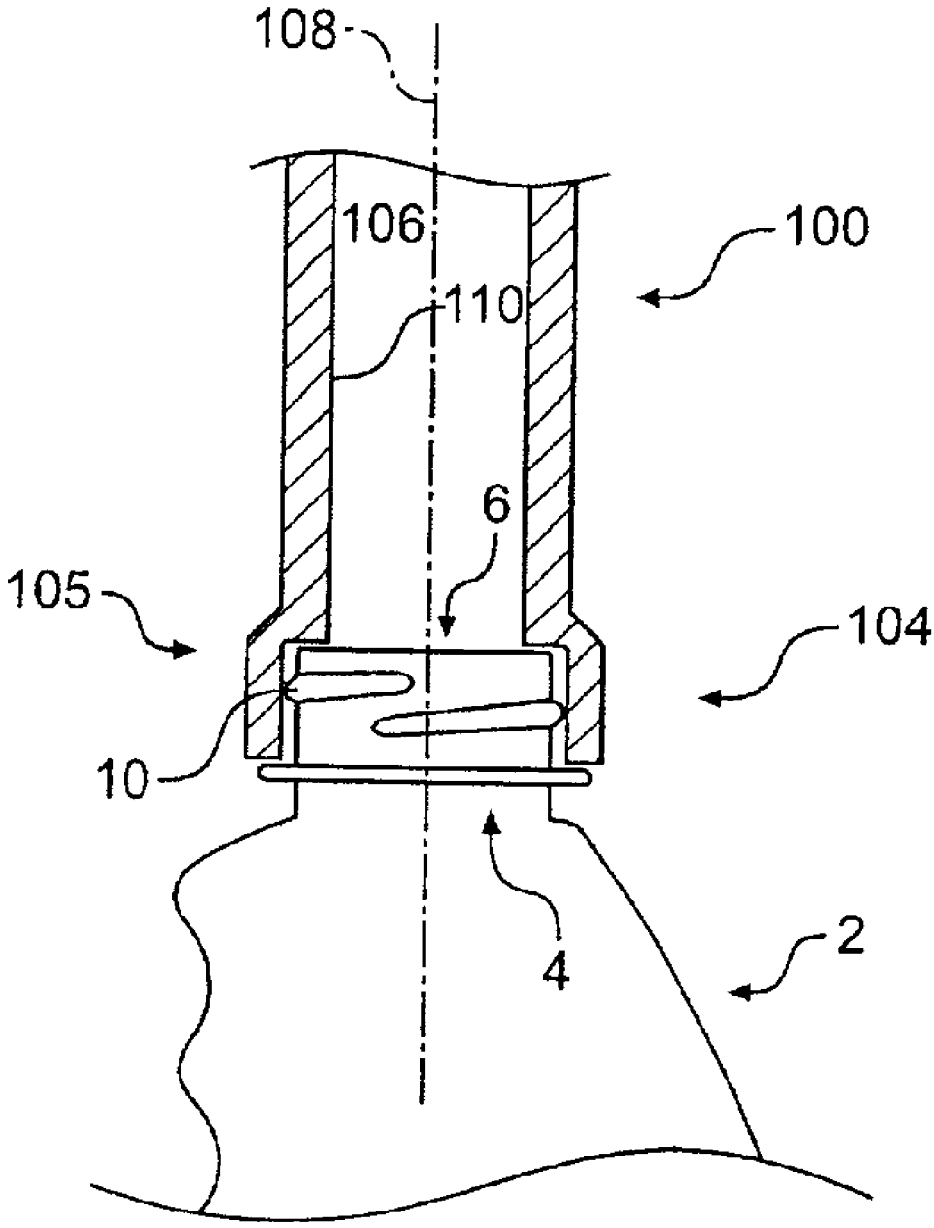

As shown in FIGS. 3 and 6A–6C, the bottom 104 of the retainer 100 is flared 105, so that the bottom 104 can removably receive or mate with the container 2. FIG. 6A shows that the inner surface 110 at the bottom 104 may be threaded to engage the threads 10 of the container 2. As shown in FIG. 6B, the inner surface 110 may be contoured so that the bottom 104 can snap onto the container 2, in which case the container 2 may be provided with a ridge 12 or other surface to mate with the contoured inner surface 110 of the retainer 100. As a further alternative (not shown), the bottom 104 of the retainer 100 and the container 2 may be engaged via a bayonet coupling. The container 2 and the retainer 100 do not need to positively mate. Rather, the flared bottom 104 of the retainer 100 may simply slip over the opening 6 of the container 2, as shown in FIG. 6C.

Figure 7:
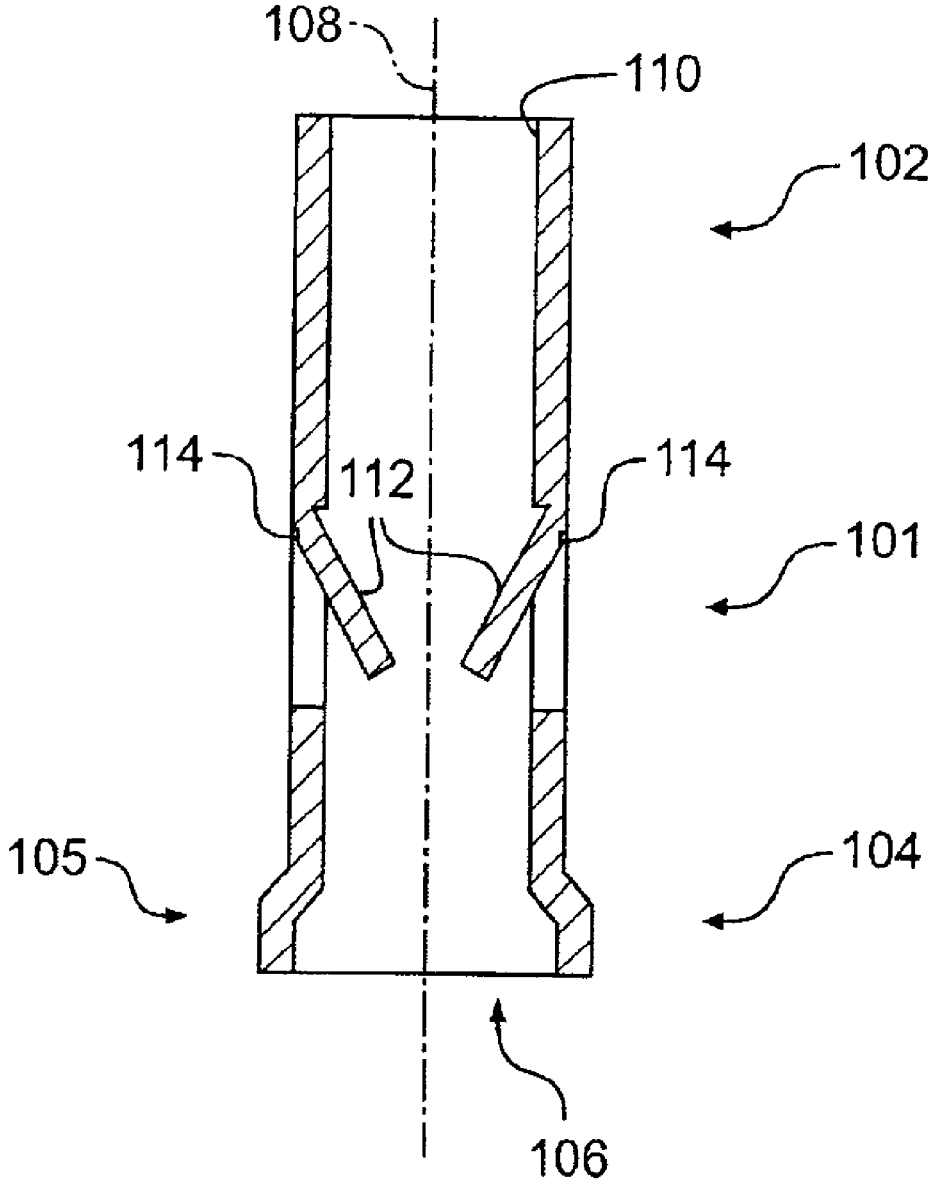
FIG. 7 is a cross-sectional view of an alternative retainer taken along the longitudinal axis of the alternative retainer.

FIG. 7 shows an alternative version of a retainer 101, which is shorter than the retainer 100 previously described, and further comprises flaps 112 that are "cut" from the sides of the retainer 101 and folded inwardly. By "cut," any process for forming the flaps 112 is intended, and not merely a cutting operation. The flaps 112 are hinged at a resilient, or "living" hinge 114, so that if displaced they will return substantially to their original position. The retainer 101 of the alternative version is otherwise the same as the retainer 100 previously described.

The retainer 100, 101 is preferably polypropylene, but other materials such as polyethylene or acrylonitrile butadiene styrene (ABS) can be used.

Figure 8:
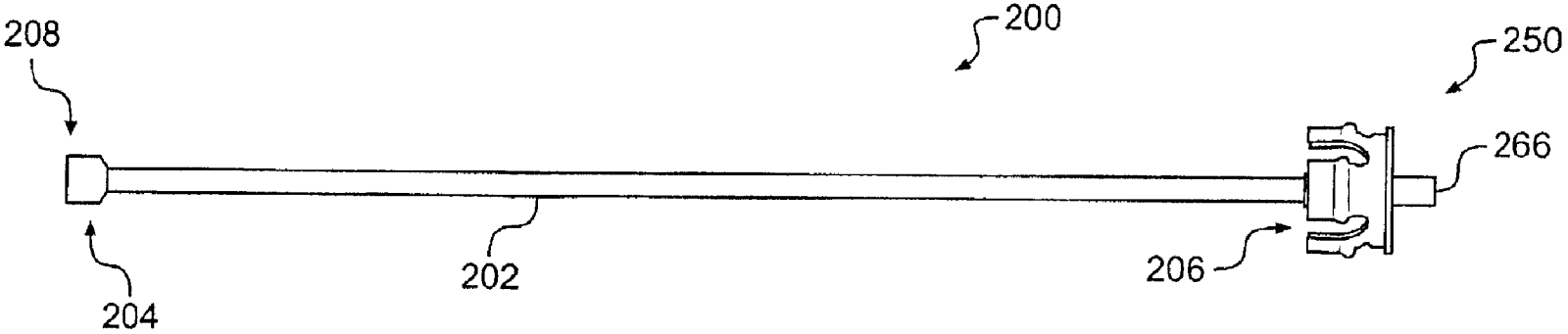
FIG. 8 is a side elevational view of a tube assembly according to the present invention.

As shown in FIG. 8, a tube assembly 200 comprises an elongated tube 202, a weight 204 and an adapter 250. The tube 202 is preferably approximately the same length as the longest distance D, discussed above, so that if a first end 206 is located at the center of the opening 6 of the container 2, a second end 208 can reach a furthest corner on the bottom surface of the container 2. Of course, the tube 202 may be slightly longer or slightly shorter, as one of ordinary skill will appreciate.

Figure 9:
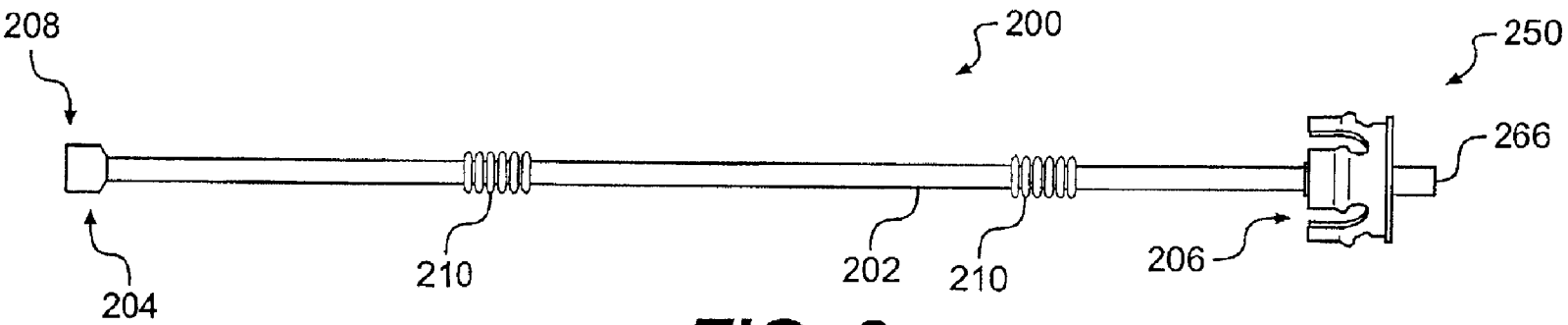
FIG. 9 is a side elevational view of a tube assembly according to the present invention having a plurality of bellows.

The tube 202 is preferably flexible, with a smooth external surface. However, as shown in FIG. 9, the tube 202 may have at least one bellows 210, or corrugation. When at least one bellows 210 is provided, the tube 202 may be comprised of a more rigid material, relying on the inherent pliability of the bellows 210 to give the tube 202 flexibility. Although two discrete bellows 210 are shown in FIG. 9, one of ordinary skill will appreciate that one, two or more bellows may be provided, or indeed, the entire length of the tube 202 may consist of a bellows 210.

The tube 202 is preferably made of silicone for its flexibility. Linear Low Density Polyethylene (LLDPE) or other plastomers, also known as ultralow density polyethylene, are more preferred, however, because of their lower cost. Other materials for the tube 202 include plastic tubing sold under the name TYGON (trademark) by Norton Performance Plastics Corporation (Akron, Ohio).

Figure 10:
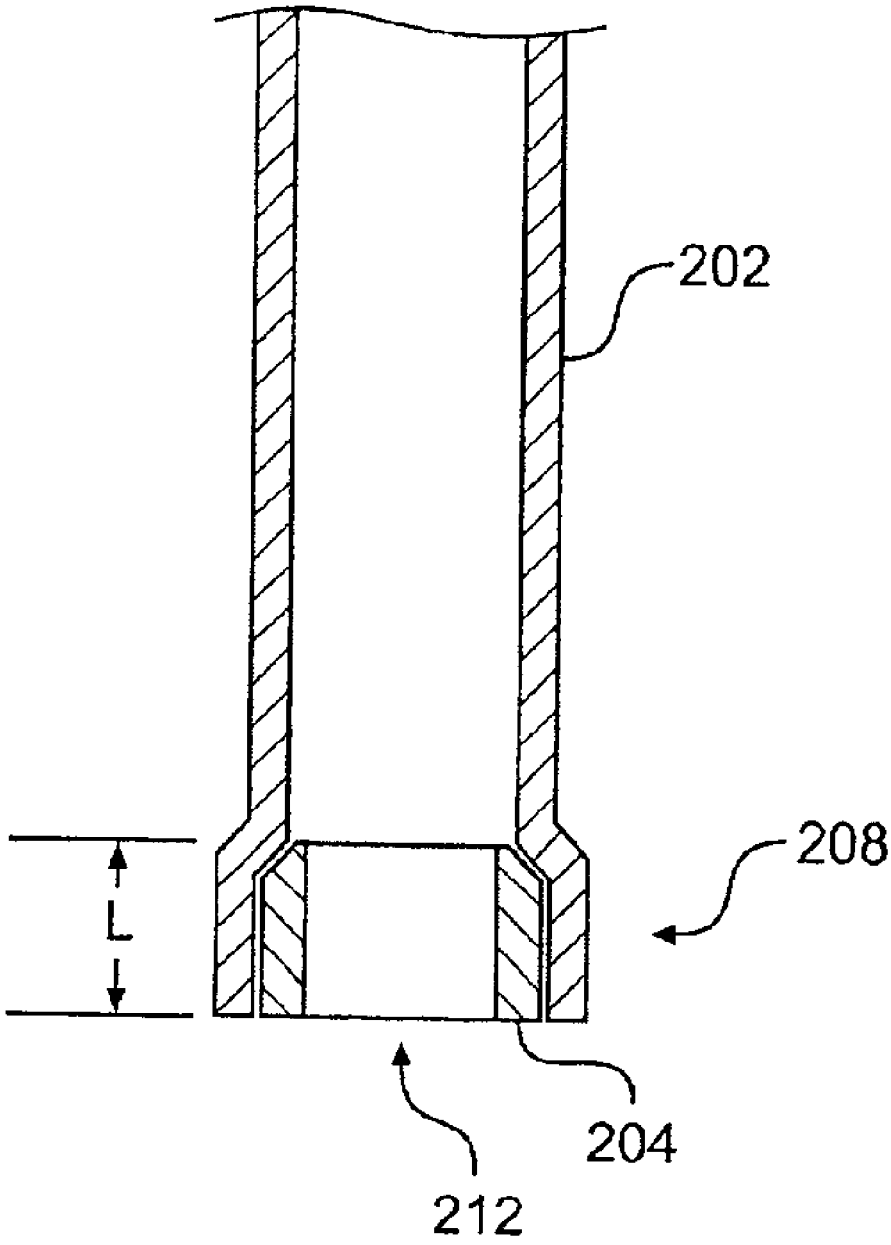
FIG. 10 is a partial cross-sectional view of a weight and a tube according to the present invention.

As will be described more fully below, along with a description of the adapter 250, the first end 206 of the tube 202 engages the adapter 250. The second end 208 preferably frictionally engages the weight 204. As shown in FIG. 10, the tube 202 preferably frictionally receives the weight 204 within the second end 208 of the tube 202, and a bore 212 in the weight 204 permits a fluid to travel past the weight 204 into the tube 202. Alternatively, the weight 204 may frictionally receive the tube 202 within its bore 212. Of course, other means for attaching the weight 204 to the tube 202 are contemplated, such as hose clamps, bands, or permanent affixation.

The weight 204 preferably comprises a longitudinal dimension L large enough so that the weight 204 will not rotate about an axis perpendicular to the longitudinal dimension L when the weight 204 is engaged with the tube 202. In this way, the centerline of the bore 212 will be prevented from rotating in such a way that the bore 212 is obstructed by the tube 202 and therefore unable to allow fluid to pass the weight 204 and enter into the tube 202.

The weight 204 is preferably stainless steel, but other materials are contemplated. For example, the weight 204 may be comprised of at least one of nickel and copper, or other metals as appropriate. Nonmetals may also be used.

As shown in FIGS. 11A-11C, 12 and 13, the adapter 250 comprises a tube receiver 266, a flange 259, an outer wall 258, and a connector for connecting the tube receiver 266 to the outer wall 258, such as a plurality of spokes 253 extending radially from the tube receiver 266. The tube receiver 266 comprises a bore 268. The tube 202 is preferably received inside the bore 268, which is preferably of such a diameter that the tube 202 is frictionally engaged inside the bore 268.

Figure 12:
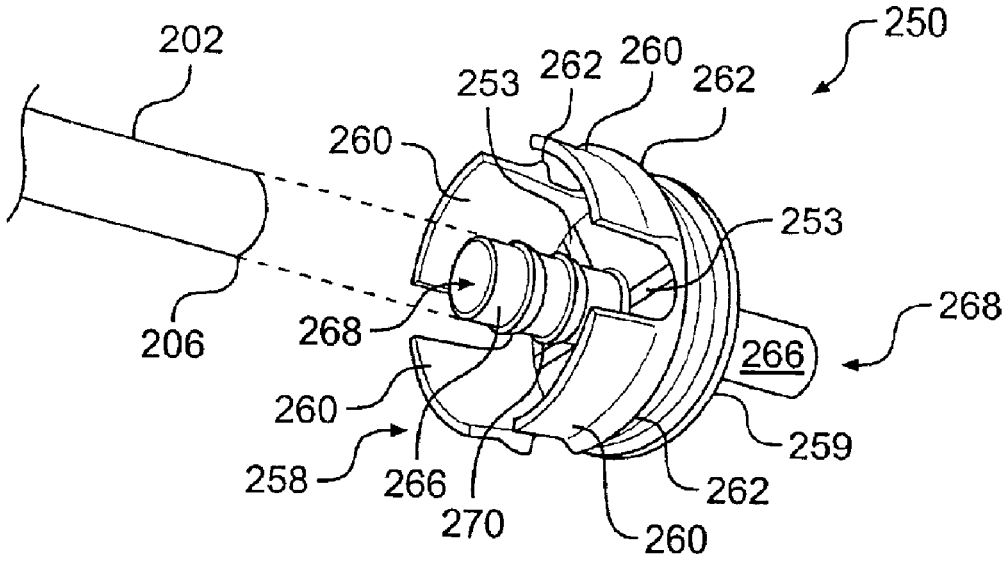

In an alternative shown in FIG. 12, the tube 202 slips over the tube receiver 266 and is frictionally engaged with the aid of at least one gripper 270. FIG. 12 shows the tube 202 distanced from the tube receiver 266 so that the grippers 270 are visible. However, the tube receiver 266 is preferably fully inserted in the tube 202 so that the bottoms of the spokes 253 contact the first end 206 of the tube 202.

The portion of the tube receiver 266 that extends from the tops of the spokes 253 is adapted to engage a portion of the trigger assembly 20, such as the input spout 24 (shown in FIG. 2), which is connected to the pump inside the trigger assembly 20. The tube receiver 266 may engage the input spout 24 in the same manner that the tube receiver 266 engages the tube 202. In other words, the tube 202 may frictionally engage the input spout 24 by fitting inside a bore of the input spout 24, by fitting over the input spout, or by fitting over grippers on the exterior of the input spout.

Figure 11A:
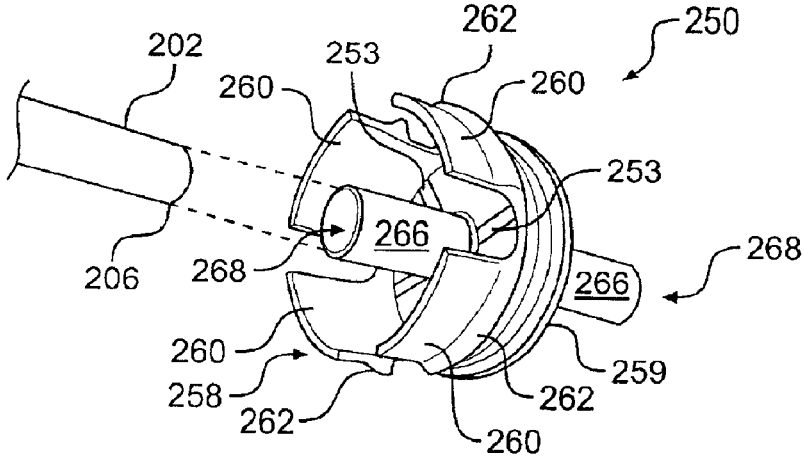
FIGS. 11A, 12 and 13 are perspective views of adapters according to the present invention.
Figure 11B:
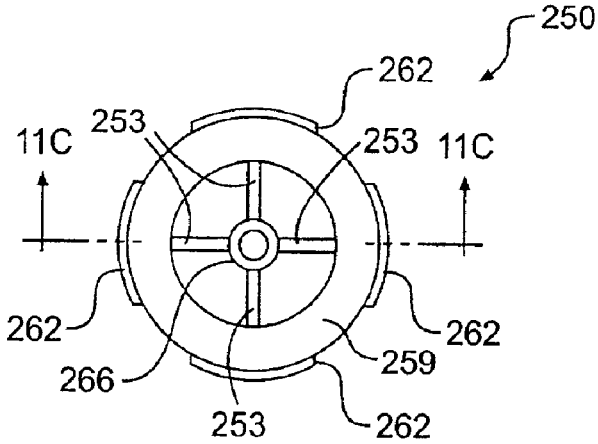
FIG. 11B is a top elevational view of the adapter shown in FIG. 11A.
Figure 11C:
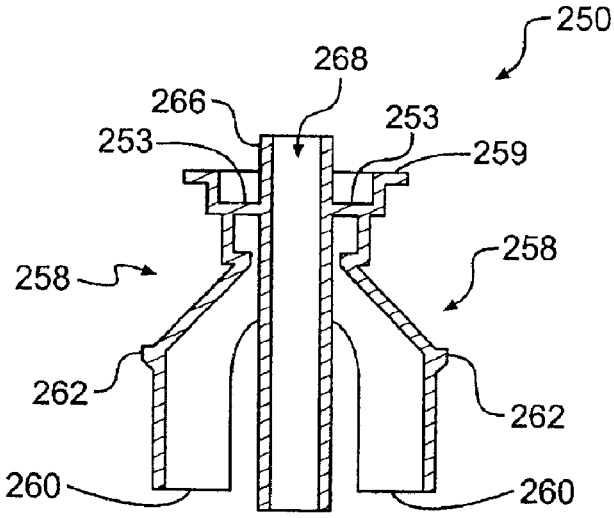
FIG. 11C is a cross-sectional view of the adapter taken along the line 11C—11C in FIG. 11B.

As shown in FIGS. 11A, 11B and 12, the outer wall 258 preferably comprises a plurality of resilient fingers 260. Each finger 260 preferably comprises an annular ridge 262. As shown, the ridge 262 spans the width of the finger 260, but the ridge 262 may instead span only part of the width of the finger 260. The annular ridge 262 may even be omitted altogether. The fingers 260 are preferably integrally formed with the remainder of the adapter 250, and protrude outwardly from the center of the adapter 250. As shown in FIG. 11B, the fingers 260 protrude such that, when the adapter 250 is viewed from above, the ridge 262 on the finger 260 is visible beyond the flange 259.

Figure 13:
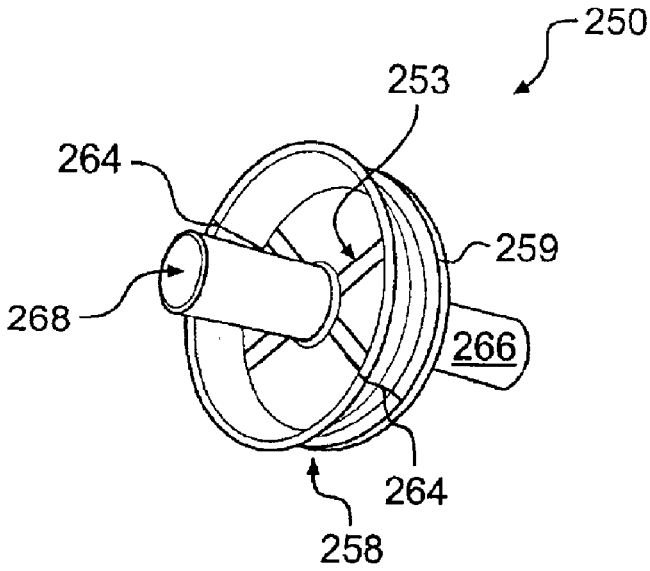

In an alternative of the adapter 250, shown in FIG. 13, the fingers 260 are omitted. In this alternative, the outer wall 258 is made resilient by providing at least one radial cut 264. One of ordinary skill will appreciate that the cut 264 may be virtually any shape, such as slits, U-shaped cutouts, triangles, rectangles, circles, ellipses, etc.

Figure 14:
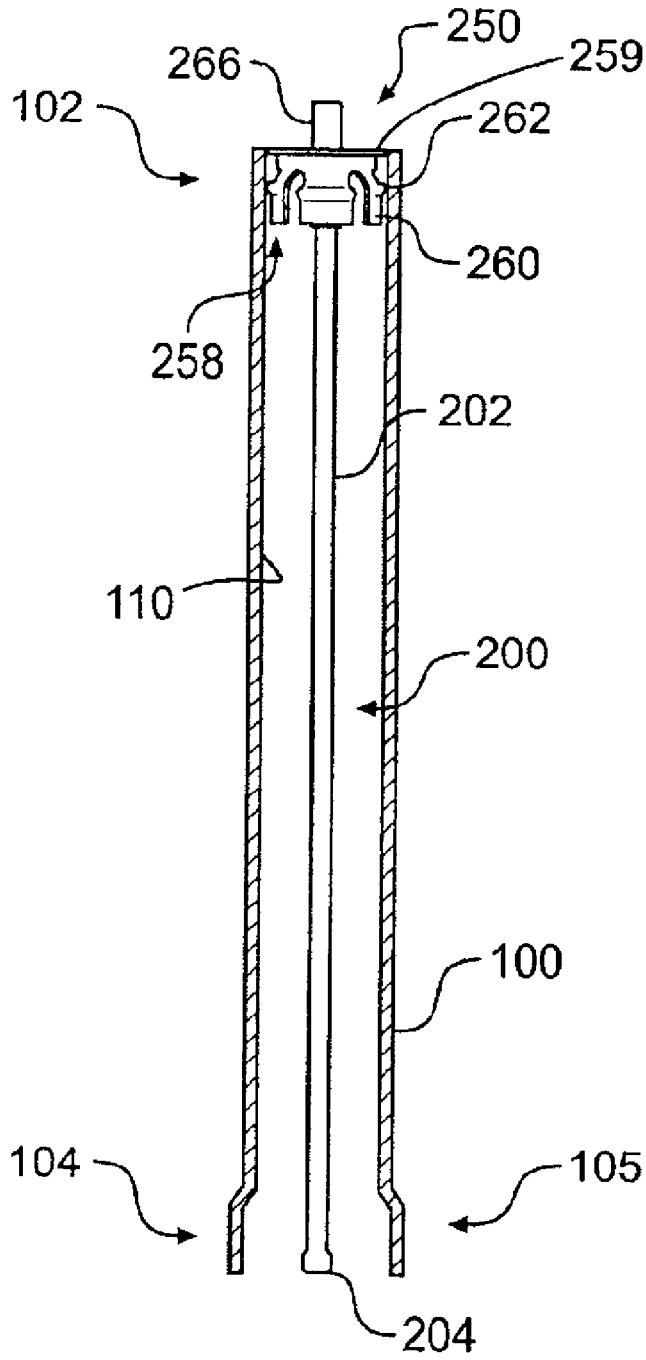
FIG. 14 is a cross-sectional view of the tube assembly in the retainer.

FIG. 14 shows the tube assembly 200 as it is assembled in the retainer 100, which is shown in cross section. As shown, the tube 202 extends approximately the entire length of the retainer 100 from top 102 to bottom 104. The inner diameter of the retainer 100 is large enough for the flange 259 to fit inside the retainer 100. In order for the adapter 250 to fit within the retainer 100, the fingers 260 are compressed. When so compressed, the ridge 262 of each finger 260 frictionally engages the inner surface 110 of the retainer 100, retaining the adapter 250, tube 202 and weight 204 in place against gravity, and also holding the flange 259 and fingers 260 away from the inner surface 110 of the retainer 100. If no fingers 260 are included with the outer wall 258, it is believed the outer wall 258 will nevertheless retain the adapter 250, tube 202 and weight 204 in place against gravity.

Figure 15:
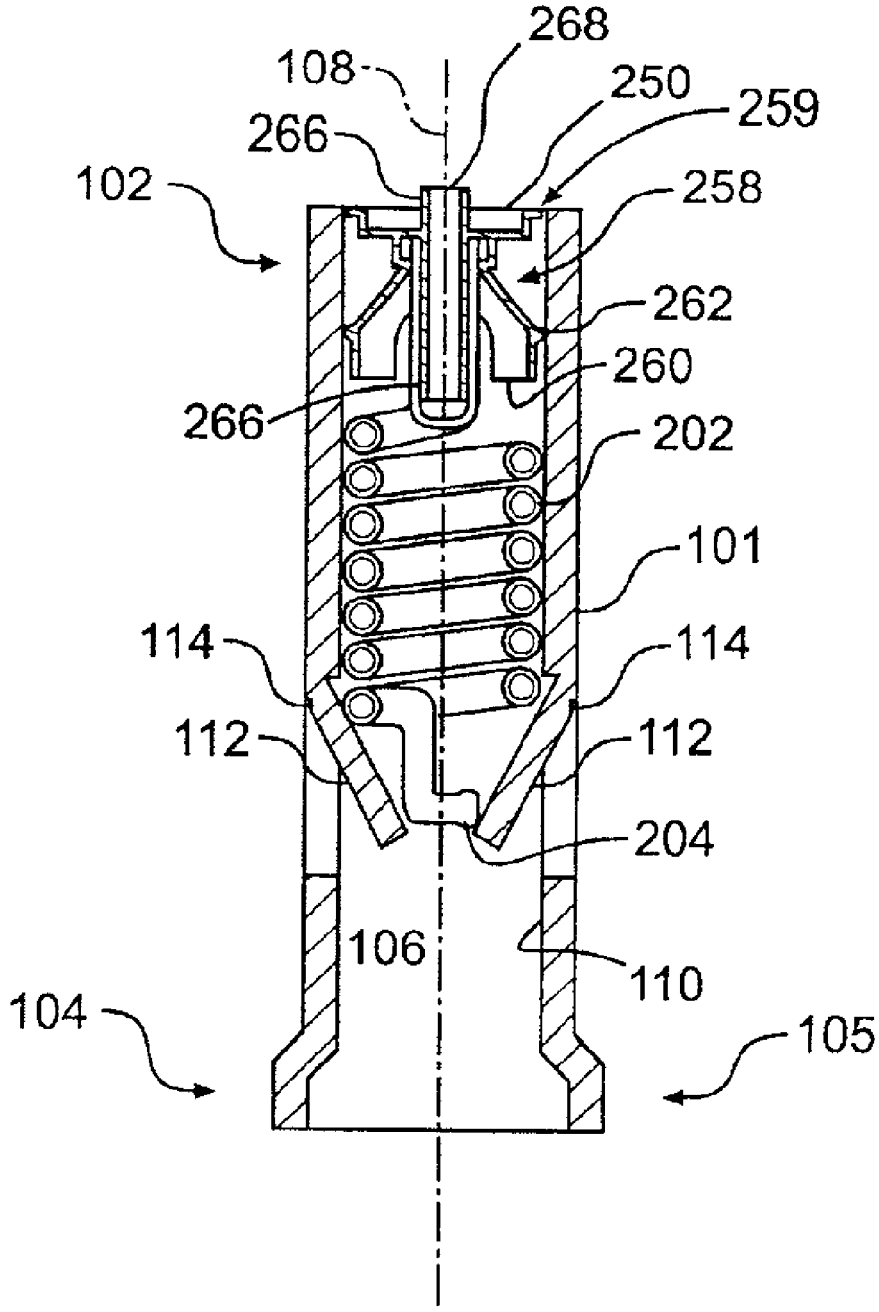
FIG. 15 is a cross-sectional view of the tube assembly in the alternative retainer.

FIG. 15 shows the tube assembly 200 in cross section as it is assembled in the alternative retainer 101. As shown, the tube 202 is coiled within the retainer 101, and the weight 204 and tube 202 are at least partially held in place against gravity by the flaps 112. In addition, the ridge 262 frictionally engages the inner surface 110 of the retainer 101 to hold the adapter 250 and tube 202 in place against gravity as well as to hold the flange 259 and each finger 260 away from the inner surface 110. Although the ridge 262 is preferably provided, the ridge 262 is not necessary to the invention.

Figure 16:
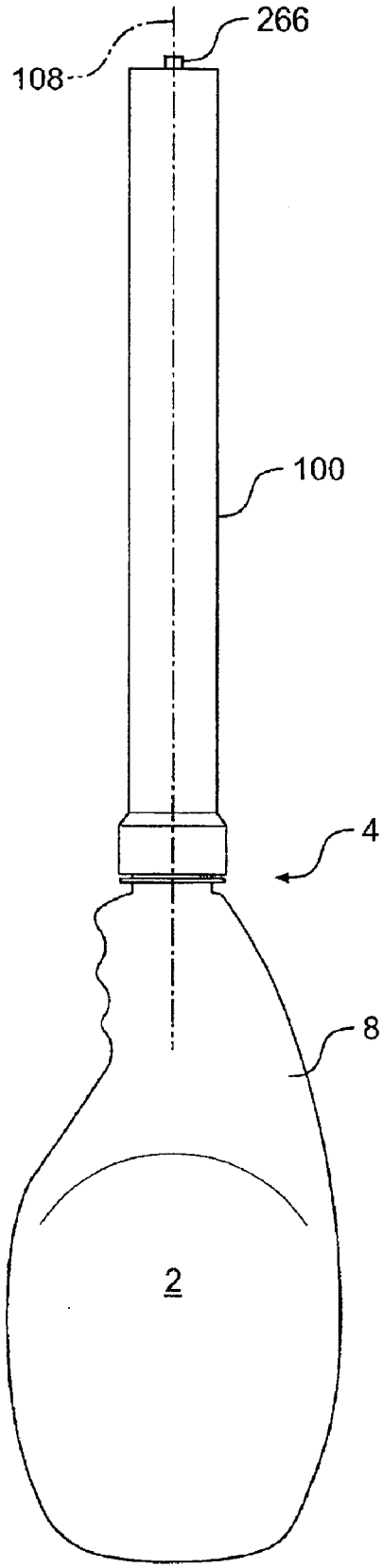
FIG. 16 is a side elevational view of the retainer mating with the top of the container.

FIG. 16 shows the retainer 100 having the tube assembly 200 disposed therein mating with the top 4 of the container 2. As one of ordinary skill will appreciate, the alternative retainer 101 may replace the retainer 100 shown in the figure. When the retainer 100, 101 is mated with the container 2 as shown, the tube assembly 200 is easily inserted into the container 2 (that is, into the interior chamber 8) by a machine, since only a simple vertical force is required to displace the adapter 250 (of which only the tube receiver 266 is visible in the figure) along the longitudinal axis 108 of the retainer 100, 101 until the fingers 260 of the adapter 250 pass into the interior chamber 8 of the container 2. Once the adapter 250 is pushed thus, referring now to FIG. 17A, the ridge 262 on each finger 260 frictionally engages the inner surface of the top 4 of the container 2. Also shown in FIG. 17A, the flange 259 of the adapter 250 abuts the container 2 to prevent the adapter 250 from moving further into the interior chamber 8.

One of ordinary skill will appreciate that the adapter 250 need not frictionally engage the top 4 of the container 2. As shown in FIG. 17B, the annular ridge 262 of the adapter 250 may hold the adapter 250 in the top 4 of the container 2 by snappingly engaging a contour 14 formed in the inner surface of the top 4 of the container 2. The contour 14 or surface in the top 4 of the container 2 may be any number of shapes, such as an indentation or a plurality of cutouts or windows, and the annular ridge 262 may have a different shape from that shown in FIG. 17B according to the best manner with which to engage the annular ridge 262 with the top 4.

Methods of using the invention will now be described with reference to FIGS. 8–9 and 14–17B. The methods may be performed by machine or by hand, or by combinations thereof.

First, the tube assembly 200 is assembled by engaging the adapter 250 with the first end 206 of the tube 202 and the weight 204 with the second end 208 of the tube 202, forming the tube assembly 200 shown in FIGS. 8 and 9. This operation may be performed entirely by hand, but preferably a machine will cut appropriate lengths of the tube 202 and an operator or machine will engage the adapter 250 and the weight 204 with the cut tube 202.

Second, the tube assembly 200 is inserted into the retainer 100 as shown in FIG. 14. As previously mentioned, the fingers 260 of the adapter 250 are compressed in order to fit the adapter 250 into the retainer 100. Once inserted, the frictional engagement of the ridges 262 of the adapter 250 with the inner surface 110 of the retainer 100 keeps the tube assembly 200 from sliding down the longitudinal axis 108 of the retainer 100. The ridges 262 also hold the flange 259 and fingers 260 away from the inner surface 110 of the retainer 100. In the alternative version of the retainer 101, shown in FIG. 15, the flaps 112 also prevent the tube assembly 200 from undesirably sliding down the longitudinal axis 108.

Third, as shown in FIG. 16, the retainer 100 with the tube assembly 200 inserted therein is brought into a mating engagement with the top 4 of the container 2, which contains fluid. This may be accomplished via a machine on an assembly line, whereby the machine grips the retainer 100 and places it on the container 2 using, for example, sensors or other means for determining the relative locations of the top 4 of the container 2 and the bottom 104 of the retainer 100. This step, of course, may also be accomplished manually.

Fourth, the tube assembly 200 is forced through the passageway 106 of the retainer 100, preferably using a machine element to displace the adapter 250. The machine element overcomes the frictional force of the ridge 262 against the inner surface 110 of the retainer 100, as well as the upward force exerted by the flaps 112, if any. As the adapter 250 is displaced, air passes through the openings between the spokes 259, thus preventing a build-up of pressure in the retainer 100 or container 2.

As the tube assembly 200 is forced down the passageway 106 of the retainer 100, in the preferred embodiment, the ridges 262 are forced inward by the tapered inner surface 110. The ridges 262 in turn forces the fingers 260 inward. When the adapter 250 is near the bottom 104 of the retainer 100, just before the fingers 260 enter the opening 6 of the container 2, the tapered inner surface 110 has forced the ridges 262 inward to such an extent that the fingers 260 enter the opening 6 without contacting the inner surface of the top 4 of the container 2. As the tube assembly 200 is forced yet further down the inner passageway 106, the ridges 262 enter into the opening 6, thereby contacting the inner surface of the top 4 of the container 2. Since the opening 6 is only slightly smaller than the inner diameter of the inner passageway 106, a smooth transition between the retainer 100 and the opening 6 is provided. The adapter 250 is forced down the passageway until the flange 259, which is larger in diameter than the opening 6, abuts the top 4 of the container 2.

Although the preferred method heretofore described contemplates an adapter 250 having an outer wall 258 with fingers 260 each having an annular ridge 262, one of ordinary skill will appreciate that the outer wall 258 need not have fingers 260 or ridges, as shown in FIG. 13.

Figure 17A:
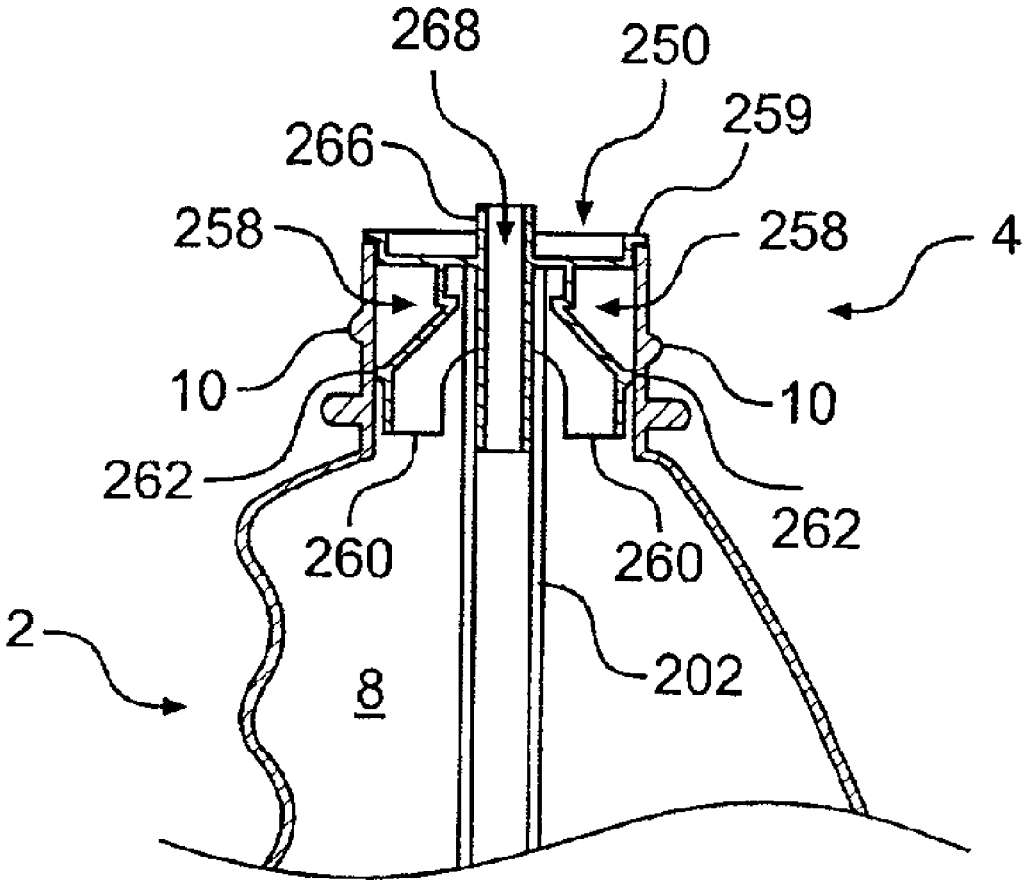
FIG. 17A is a partial cross-sectional view of the adapter frictionally engaging the flat inner surface of the top of the container.
Figure 17B:
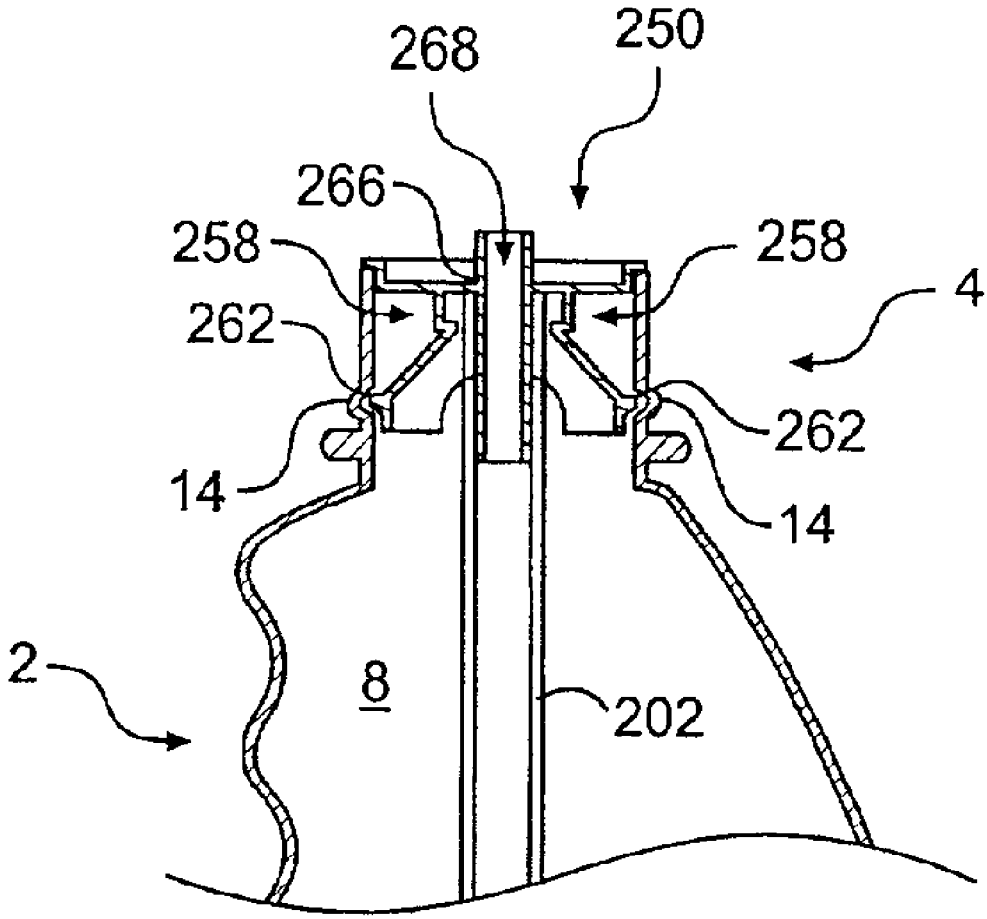
FIG. 17B is a partial cross-sectional view of the adapter snappingly engaging the inner surface of the top of the container.

As described previously, the ridge 262 may frictionally engage the inner surface of the top 4 (as shown in FIG. 17A), or the ridge 262 may snappingly engage the inner surface of the top 4, whereby respective contours 14, 262 in the inner surface of the top 4 of the container 2 and the outer wall 258 of the adapter 250 mate (as shown in FIG. 17B).

Figure 18:
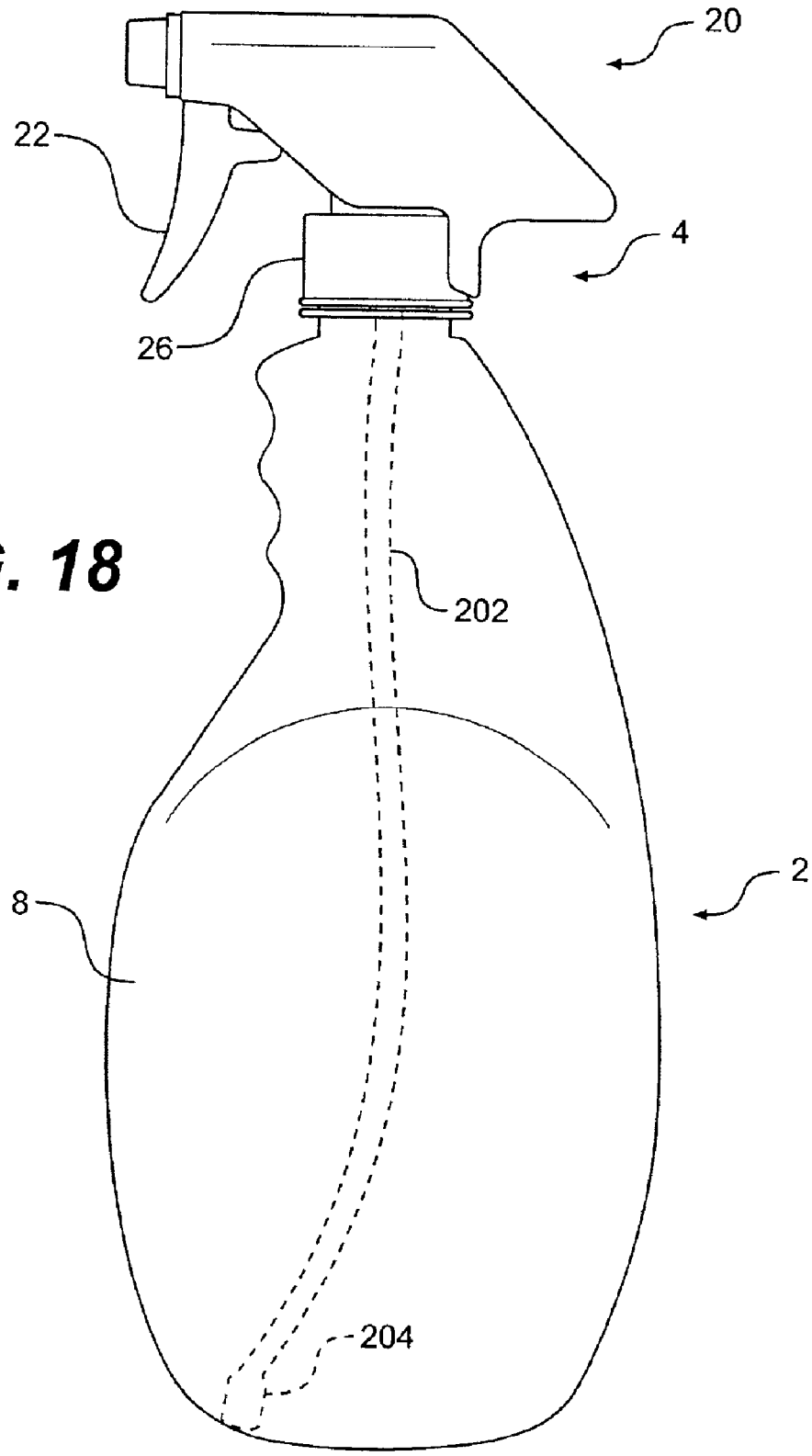
FIG. 18 is a cross-sectional view of the tube assembly disposed within the container and the trigger assembly attached to the container.

In the fifth and final step, the retainer 100 is removed, the trigger assembly 20 is placed over the opening 6, and the lock ring 26 is turned. Turning the lock ring 26 engages the threads on the inner surface of the lock ring 26 with the threads 10 on the top 4 of the container 2. As the respective threads of the lock ring 26 and the container 2 engage, the trigger assembly 20 is displaced downward, causing the input spout 24 to frictionally engage the tube receiver 266. As previously described, the input spout 24 may fit over the tube receiver 266, or the input spout 24 may fit inside the bore 268 of the tube receiver 266. Once the lock ring 26 is turned as far as the threads will allow, the trigger assembly 20 is completely mated with the tube assembly 200. This finished product is shown in FIG. 18.

When so mated, a continuous fluid path is created that extends through the bore 212 of the weight 204 into the tube 202, through the tube 202 into the input spout 24 of the trigger assembly 20, past the pump in the trigger assembly 20, and out of the trigger assembly 20. The device as shown in FIG. 18 has the advantage that gravity will force the weight 204 (which is connected to the tube 202) into the same position that gravity forces the fluid within the container 2. Therefore, regardless of the orientation of the container 2, fluid can be withdrawn from the interior chamber 8 of the container 2.

The above steps may be performed using the alternative version retainer 101 as well. In that case, the tube assembly 200 is inserted so that the tube 202 is coiled within the retainer 101, and the flaps 112 hold the weight 204 and the coiled tube 202 in place. This coiling is what enables the retainer 101 to be shorter than the retainer 100.

DETAILED DESCRIPTION OF THE SECOND EMBODIMENT

The second embodiment involves a modification of the retainers 100, 101, the adapter 250 and the method of using the device described with reference to the first embodiment. A description of all other aspects is omitted.

Figure 19:
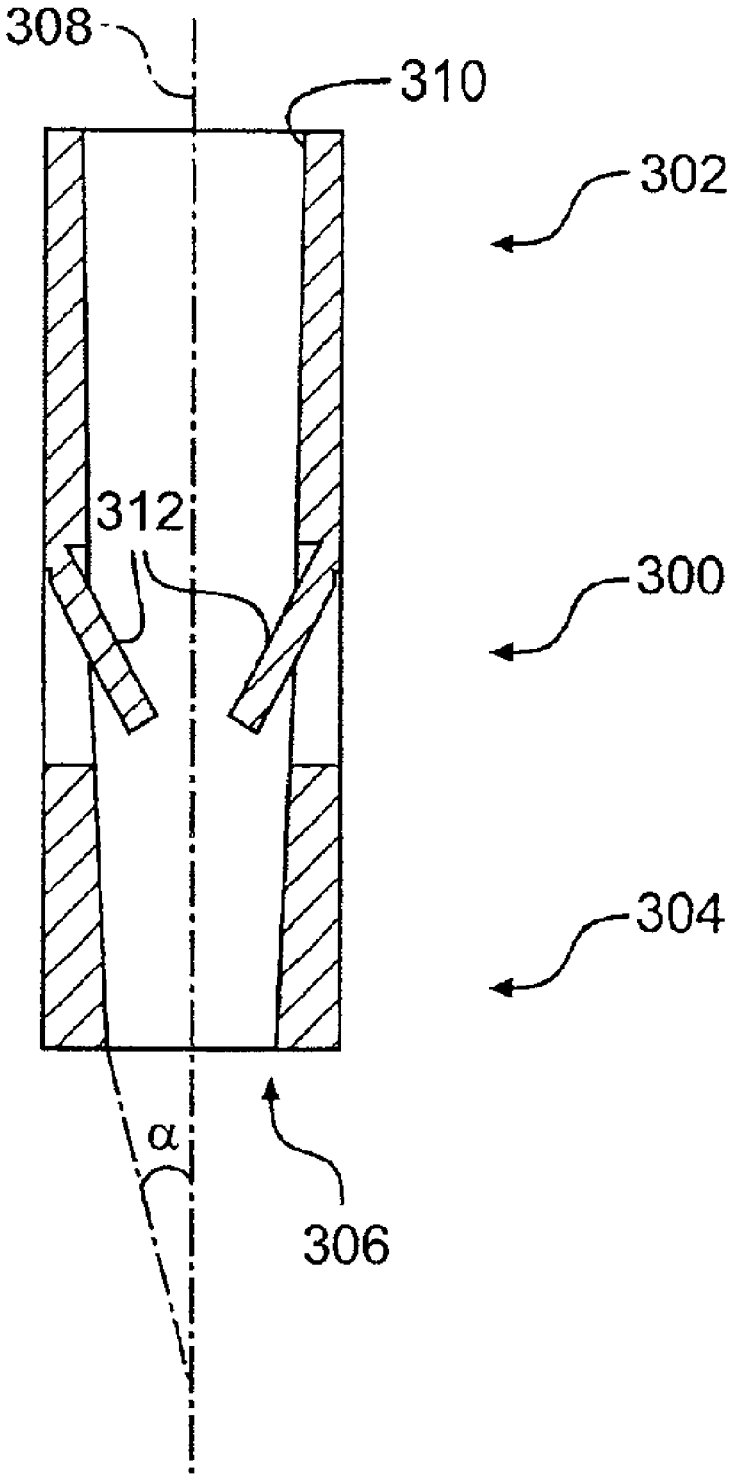
FIG. 19 is a cross-sectional view of a retainer according to the second embodiment of the invention.

As shown in FIG. 19, a retainer 300 according to the second embodiment comprises a top 302, a bottom 304, an inner passageway 306 defined by an inner surface 310, and a longitudinal axis 308. The retainer 300 also includes flaps 312, which are "cut" out of the wall of the retainer 300 in the same manner described with respect to the flaps 112 according to the first embodiment. The retainer 300 also includes a taper, similar to the taper included in the retainer 100 of the first embodiment. As in the case of the device shown in FIG. 5, the taper of the retainer 300 shown in FIG. 19 has been exaggerated for illustration.

The length of the retainer 300 is preferably approximately the same as the length of the alternative version of the retainer 101 according to the first embodiment because, as will be described later, the tube 202 will be coiled within the retainer 300 in the same manner that the tube 202 is coiled in the alternative version of the retainer 101.

Figure 20:
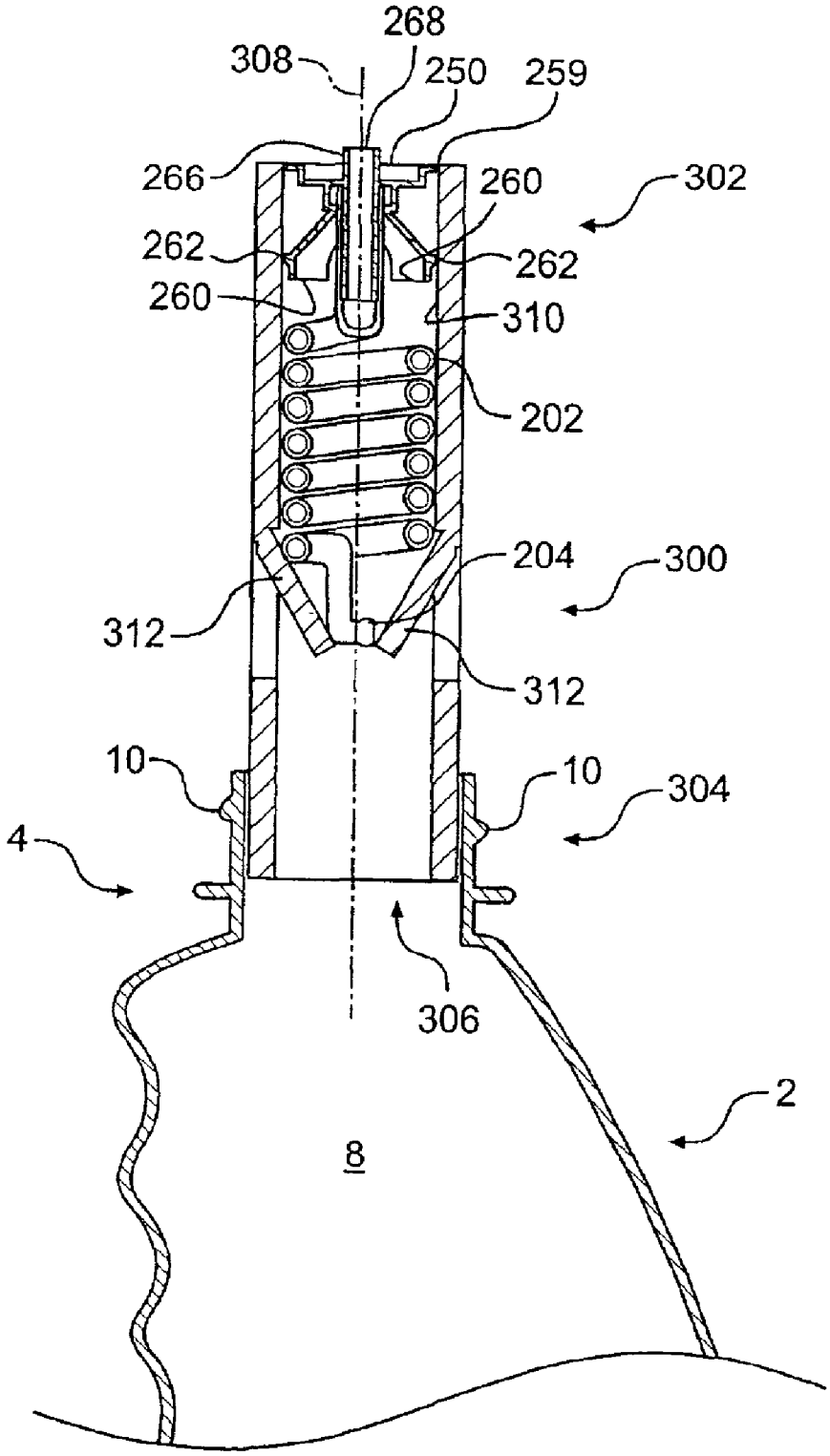
FIG. 20 is a cross-sectional view of the retainer according to the second embodiment frictionally engaging the inner surface of the top of the container.

The retainer 300 is adapted to frictionally engage the inner surface of the top 4 of the container 2, as shown in FIG. 20. The adapter 250, in turn, frictionally engages the inner surface 310 of the retainer 300. For illustrative purposes, the retainer 300 is only partially inserted into the interior chamber 8 of the container 2, but the retainer 300 is preferably fully inserted so that the top 302 of the retainer 300 is approximately flush with the topmost surface of the container 2. Alternatively, the retainer 300 comprises a flange (not shown) about its top 302 (similar to the flange 259 of the adapter 250), which abuts the top 4 of the container 2 upon full insertion of the retainer 300 into the container 2.

To assemble the apparatus, the tube assembly 200 is first placed inside the retainer 300, so that the tube 202 is coiled within the retainer 300. The flaps 312 hold the weight 204 and the coiled tube 202 in place. As shown in FIG. 20, the adapter 250 is descended into the retainer 300 so that the ridges 262 frictionally engage the inner surface 310.

Next, the retainer 300 having the tube assembly 200 placed therein is inserted into the interior chamber 8 of the container 2, such that the retainer 300 frictionally engages the inner surface of the container 2. As previously mentioned, the retainer 300 is preferably inserted totally into the interior chamber 8 of the container 2. However, part of the retainer 300 may protrude outside of the interior chamber 8.

Figure 21:
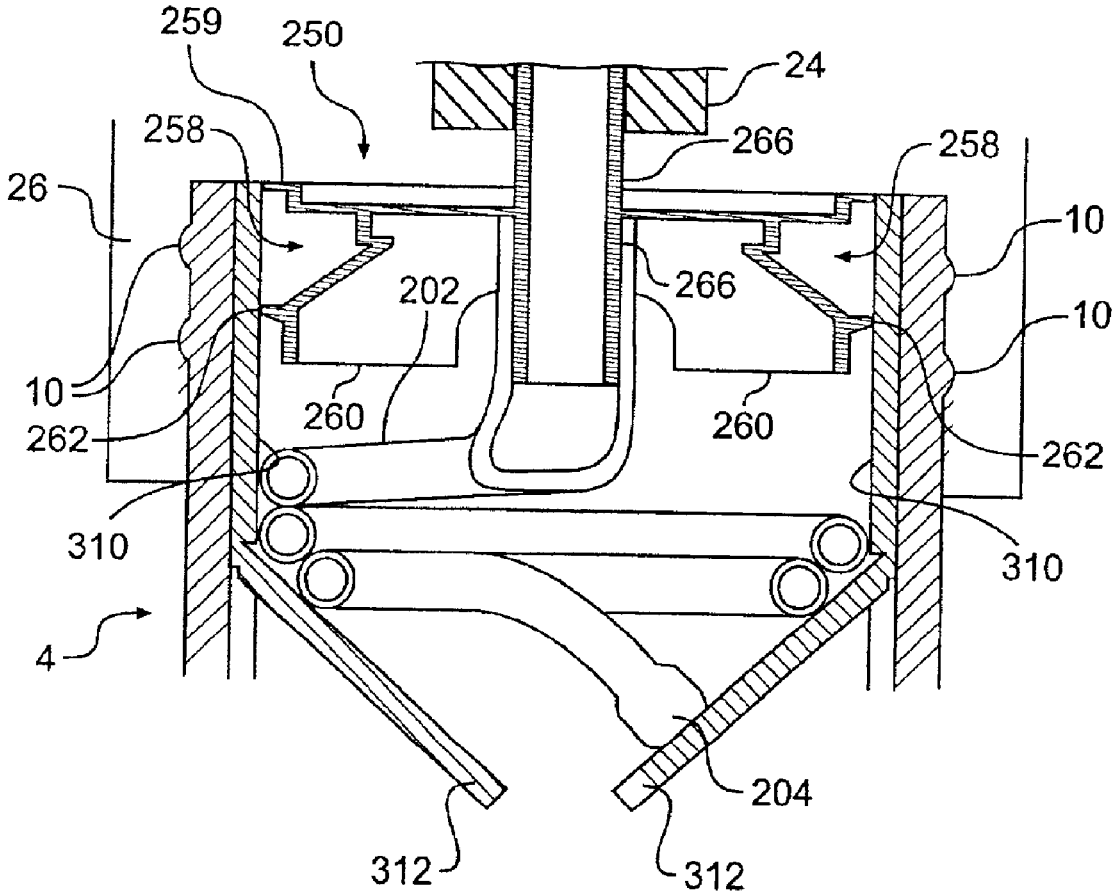
FIG. 21 is a partial cross-sectional view of the retainer and the tube assembly according to the second embodiment.

The trigger assembly 20 is then placed onto the container 2. Referring to FIG. 21, as the lock ring 26 on the trigger assembly 20 is threaded onto the threads 10 of the container 2, the following two events occur: the input spout 24 frictionally engages the tube receiver 266 on the adapter 250 and the adapter 250 is pushed down by the trigger assembly 20 just enough to force the weight 204 past the flaps 312.

The mechanism by which the weight 204 is pushed past the flaps 312 is best described with reference to FIG. 21. As the lock ring 26 is threaded onto the threads 10, the trigger assembly 20 descends, contacting the adapter 250 and causing it to frictionally slide against the inner surface 310 of the retainer 300. As the adapter 250 slides, it exerts a force on the tube 202 that overcomes the upward force provided by the flaps 312. As a result, the weight 204 falls past the flaps 312 to the bottom of the container 2.

INDUSTRIAL APPLICABILITY

This invention is useful for withdrawing substantially all of the fluid from a container equipped with a trigger assembly, regardless of the angle of tilt of the container. The device of this invention may be manufactured in a cost-effective manner.

While the invention has been described with respect to what are at present considered to be the preferred embodiments, it should be understood that the invention is not limited to the disclosed embodiments. To the contrary, as exemplified above, the invention is intended to cover various modifications and equivalent arrangements included within the spirit and scope of the appended claims. Therefore, the scope of the following claims is intended to be accorded the broadest reasonable interpretations so as to encompass all such modifications and equivalent structures and functions.

What is claimed is:

1. A device for use with a container having a container top, said device comprising:

a tubular retainer for engaging the container top, said tubular retainer having a retainer top, a retainer bottom, a longitudinal axis, and an inner passageway formed along the longitudinal axis and defined by an inner surface; and a tube assembly disposed within the inner passageway of said tubular retainer, said tube assembly comprising (i) a tube having a first end and a second end, (ii) a weight attached to the second end of said tube, and (iii) an adapter attached to the first end of said tube, said tubular retainer being sized such that substantially all of said tube assembly can be disposed within said tubular retainer.

2. A device according to claim 1, the container having an opening in the container top, wherein the retainer bottom engages the container top such that said adapter is longitudinally movable along the inner passageway of said tubular retainer to the opening in the container top.

3. A device according to claim 2, the container having an interior chamber and a plurality of distances from a center of the opening to points of the interior chamber, said tube assembly having a length substantially equal to at least the longest of the plurality of distances from the center of the opening to the points of the interior chamber, wherein said tubular retainer has a length that is substantially equal to at least the length of said tube assembly.

4. A device according to claim 3, said adapter comprising (i) an outer wall shaped to frictionally engage the inner surface of said tubular retainer, (ii) a tube receiver having a longitudinal bore formed therein, said tube receiver frictionally engaging the first end of said tube, and (iii) a connector for connecting said outer wall to said tube receiver.

5. A device according to claim 4, said outer wall comprising a plurality of resilient fingers shaped to frictionally engage the inner surface of said tubular retainer.

6. A device according to claim 4, wherein said connector is a plurality of spokes extending radially outward from said tube receiver.

7. A device according to claim 5, wherein the first end of said tube is frictionally received within the longitudinal bore of said tube receiver.

8. A device according to claim 3, wherein said tube comprises at least one bellows.

9. A device according to claim 3, wherein said tube is continuously flexible from the first end to the second end of said tube.

10. A device according to claim 2, said tubular retainer comprising at least two flaps hinged to and integrally formed with said tubular retainer such that said at least two flaps are movable between a holding position close to the longitudinal axis of said tubular retainer and a releasing position away from the longitudinal axis of said tubular retainer, wherein said tube is coiled within said tubular retainer, and said tube and said weight are supported by said at least two flaps when said at least two flaps are in the holding position.

11. A device according to claim 10, said adapter comprising (i) an outer wall shaped to frictionally engage the inner surface of said tubular retainer when disposed in the inner passageway, (ii) a tube receiver having a longitudinal bore formed therein, said tube receiver frictionally engaging the first end of said tube, and (iii) a connector for connecting said outer wall to said tube receiver.

12. A device according to claim 11, said outer wall comprising a plurality of resilient fingers shaped to frictionally engage the inner surface of said tubular retainer.

13. A device according to claim 11, wherein said connector is a plurality of spokes extending radially outward from said tube receiver.

14. A device according to claim 13, wherein the first end of said tube is frictionally received within the longitudinal bore of said tube receiver.

15. A device according to claim 11, wherein said tube comprises at least one bellows.

16. A device according to claim 11, wherein said tube is continuously flexible from the first end to the second end of said tube.

17. A device according to claim 1, wherein at least a portion of said tube is flexible.

18. A device according to claim 1, wherein said tube is continuously flexible from the first end to the second end of said tube.

19. A device according to claim 1, wherein said tubular retainer is frictionally disposed in the interior chamber of the container.

20. A device according to claim 19, said tubular retainer comprising at least two flaps hinged to and integrally formed with said tubular retainer such that said at least two flaps are movable between a holding position close to the longitudinal axis of said tubular retainer and a releasing position away from the longitudinal axis of said tubular retainer, wherein said tube is coiled within said tubular retainer, and said tube and said weight are supported by said at least two flaps when said at least two flaps are in the holding position.

21. A device according to claim 19, said adapter comprising (i) an outer wall shaped to frictionally engage the inner surface of said tubular retainer when disposed in the inner passageway, (ii) a tube receiver having a longitudinal bore formed therein, said tube receiver frictionally engaging the first end of said tube, and (iii) a connector for connecting said outer wall to said tube receiver.

22. A device according to claim 21, said outer wall comprising a plurality of resilient fingers shaped to frictionally engage the inner surface of said tubular retainer.

23. A device according to claim 21, wherein said connector is a plurality of spokes extending radially from said tube receiver.

24. A device according to claim 23, wherein the first end of said tube is frictionally received within the longitudinal bore of said tube receiver.

25. A device according to claim 19, wherein said tube comprises at least one bellows.

26. A device according to claim 19, wherein said tube is continuously flexible from the first end to the second end of said flexible tube.

27. A method of engaging a tube assembly with a container having a container top, said method comprising the steps of:

assembling a tube assembly, the tube assembly comprising an adapter, a tube connected to the adapter, and a weight connected to the tube;

inserting substantially all of the tube assembly into a tubular retainer, the tubular retainer having a retainer bottom and an inner passageway defined by an inner surface, such that by inserting substantially all of the tube assembly the adapter engages the inner surface of the tubular retainer and the tubular retainer houses substantially all of the tube assembly; and engaging the tubular retainer with the container top.

28. A method according to claim 27, the tubular retainer comprising a flared retainer bottom shaped to fit over an opening in the container top, said engaging step comprising placing the flared retainer bottom over the opening of the container.

29. A method according to claim 28, wherein the flared retainer bottom is threaded on an inside surface thereof and the container top is threaded on an outside surface thereof, said engaging step comprising threading the tubular retainer onto the container top.

30. A method according to claim 28, the container comprising an opening in the container top that provides access to an interior chamber of the container, the method further comprising forcing the tube assembly through the inner passageway of the tubular retainer by pushing the adapter with a machine element, such that the adapter is disposed in the opening of the container and the tube extends into the interior chamber.

31. A method according to claim 30, wherein the adapter comprises a tube receiver having a bore, the tube engaged with the tube receiver such that the bore of the tube receiver and an interior of the tube are in fluid communication, the method further comprising attaching a trigger assembly to the adapter, the trigger assembly having an input spout, said attaching step comprising frictionally engaging the input spout of the trigger assembly with the tube receiver of the adapter such that the interior of the tube, the bore of the tube receiver and an interior of the input spout are in fluid communication.

32. A method according to claim 28, wherein the tubular retainer comprises at least two flaps hinged to and integrally formed with the tubular retainer such that the at least two flaps are movable between a holding position close to a longitudinal axis of the tubular retainer and a releasing position away from the longitudinal axis of the tubular retainer, wherein during said inserting step the at least two flaps are in the holding position, said inserting step comprising coiling the tube in the tubular retainer such that the weight and coiled tube are supported by the at least two flaps.

33. A method according to claim 32, further comprising forcing the tube assembly through the passageway by pushing the adapter with a machine element such that the at least two flaps are pushed to the releasing position.

34. A method according to claim 28, the adapter comprising an outer wall, said inserting step comprising frictionally engaging the outer wall with the inner surface of the tubular retainer.

35. A method according to claim 28, the adapter comprising an outer wall comprising a plurality of fingers, said inserting step comprising frictionally engaging the plurality of fingers of the outer wall with the inner surface of the tubular retainer.

36. A method according to claim 27, the container having an opening in the container top and an interior chamber defined by a container inner surface, said engaging step comprising inserting the tubular retainer into the opening and frictionally engaging the tubular retainer with the container inner surface.

37. A method according to claim 36, wherein the tubular retainer comprises at least two flaps hinged to and integrally formed with the tubular retainer such that the at least two flaps are movable between a holding position close to a longitudinal axis of the tubular retainer and a releasing position away from the longitudinal axis of the tubular retainer, wherein during said inserting step the at least two flaps are in the holding position, said inserting step comprising coiling the tube in the tubular retainer such that the weight and coiled tube rest on the at least two flaps.

38. A method according to claim 37, further comprising attaching a trigger assembly, the trigger assembly comprising a lock ring having threads on an interior surface thereof, the lock ring adapted to fit over the opening in the container and engage threads disposed on an outer surface of the container top, said attaching step comprising screwing the lock ring onto the container, said screwing step displacing the adapter, which in turn pushes the tube, which in turn moves the at least two flaps to the releasing position.

39. A method according to claim 27, further comprising forcing the tube assembly through the passageway by pushing the adapter with a machine element.

40. A method according to claim 27, wherein at least a portion of the tube is flexible.

41. A method according to claim 27, wherein the tube is continuously flexible from a first end to a second end of the tube.

42. A method of inserting a tube assembly into a container having a container top, said method comprising the steps of:

providing substantially all of a tube assembly disposed within a tubular retainer, the tube assembly comprising an adapter and a tube connected to the adapter, the tubular retainer having a retainer bottom and an inner passageway defined by an inner surface, such that the tubular retainer houses substantially all of the tube assembly and the adapter engages the inner surface of the tubular retainer;

engaging the tubular retainer with the container top; and forcing the tube assembly through the inner passageway of the tubular retainer by pushing the adapter with a machine element.

43. A method according to claim 42, said providing step further comprising providing the tube assembly with a weight connected to the tube.

44. A method according to claim 42, wherein at least a portion of the tube is flexible.

45. A method according to claim 42, wherein the tube is continuously flexible from a first end to a second end of the tube.

46. A device for use with a container having a container top, an opening in the container top, an interior chamber, and a plurality of distances from a center of the opening to points of the interior chamber, said device comprising:

a tubular retainer for engaging the container top, said tubular retainer having a retainer top, a retainer bottom, a longitudinal axis, and an inner passageway formed along the longitudinal axis and defined by an inner surface; and a tube assembly disposed within the inner passageway of said tubular retainer, said tube assembly comprising (i) a tube having a first end and a second end, (ii) a weight attached to the second end of said tube, and (iii) an adapter attached to the first end of said tube, said tube assembly having a length substantially equal to at least the longest of the plurality of distances from the center of the opening to the points of the interior chamber, said tubular retainer having a length substantially equal to at least the length of said tube assembly such that substantially all of said tube assembly can be housed within said tubular retainer, wherein the retainer bottom engages the container top such that said adapter is longitudinally movable along the inner passageway of said tubular retainer to the opening in the container top.

47. A device according to claim 46, said adapter comprising (i) an outer wall shaped to frictionally engage the inner surface of said tubular retainer, (ii) a tube receiver having a longitudinal bore formed therein, said tube receiver frictionally engaging the first end of said tube, and (iii) a connector for connecting said outer wall to said tube receiver.

48. A device according to claim 47, said outer wall comprising a plurality of resilient fingers shaped to frictionally engage the inner surface of said tubular retainer.

49. A device according to claim 47, wherein said connector is a plurality of spokes extending radially outward from said tube receiver.

50. A device according to claim 48, wherein the first end of said tube is frictionally received within the longitudinal bore of said tube receiver.

51. A device according to claim 46, wherein said tube comprises at least one bellows.

52. A device according to claim 46, wherein said tube is continuously flexible from the first end to the second end of said tube.

53. A method of engaging a tube assembly with a container having a container top, said method comprising the steps of:

assembling a tube assembly, the tube assembly comprising an adapter having an outer wall having a plurality of fingers, a tube connected to the adapter, and a weight connected to the tube;

inserting the tube assembly into a tubular retainer, the tubular retainer having a flared retainer bottom shaped to fit over an opening in the container top, and having an inner passageway defined by an inner surface, said inserting step comprising engaging the plurality of fingers of the outer wall with the inner surface of the tubular retainer; and engaging the tubular retainer with the container top, said engaging step comprising placing the flared retainer bottom over the opening of the container.

* * * * *